US010765582B2

(12) United States Patent
Halperin

(10) Patent No.: US 10,765,582 B2
(45) Date of Patent: Sep. 8, 2020

(54) APPARATUS FOR STIMULATING SYNCHRONIZED BODY MOTIONS OF A USER

(71) Applicant: Mopair Technologies Ltd., Moshav Givat Nili (IL)

(72) Inventor: Uri Halperin, Moshav Givat Nili (IL)

(73) Assignee: Mopair Technologies Ltd., Hadera (IL)

( * ) Notice: Subject to any disclaimer, the term of this patent is extended or adjusted under 35 U.S.C. 154(b) by 1113 days.

(21) Appl. No.: 15/107,485

(22) PCT Filed: Dec. 23, 2014

(86) PCT No.: PCT/IL2014/051122

§ 371 (c)(1),
(2) Date: Jun. 23, 2016

(87) PCT Pub. No.: WO2015/097701

PCT Pub. Date: Jul. 2, 2015

(65) Prior Publication Data

US 2016/0324713 A1 Nov. 10, 2016

Related U.S. Application Data

(60) Provisional application No. 61/920,742, filed on Dec. 25, 2013.

(51) Int. Cl.
*A61H 1/02* (2006.01)
*A47C 1/00* (2006.01)
(Continued)

(52) U.S. Cl.
CPC ..... *A61H 1/0281* (2013.01); *A61H 1/0244* (2013.01); *A61H 1/0262* (2013.01);
(Continued)

(58) Field of Classification Search
CPC ..... A61H 1/02; A61H 1/0292; A61H 1/0237; A61H 2203/0425; A61H 2203/0431; A61H 2201/164
See application file for complete search history.

(56) References Cited

U.S. PATENT DOCUMENTS 2,550,841 A * 5/1951 Martinez ..... A61H 1/02 601/26
2,695,017 A * 11/1954 Herrmeyer ..... A61G 13/009 606/245
(Continued)

FOREIGN PATENT DOCUMENTS

CN 201019975 2/2008
EP 1486140 12/2004
(Continued)

OTHER PUBLICATIONS

Communication Relating to the Results of the Partial International Search dated Mar. 23, 2015 From the International Searching Authority Re. Application No. PCT/IL2014/051122.
(Continued)

*Primary Examiner* — Justine R Yu
*Assistant Examiner* — Christopher E Miller

(57) ABSTRACT

An apparatus and method are provided for imparting a repetitive motion to a user. The apparatus may include one or more seat platforms and one or more backrests. Repeated motion of the pelvis and shoulders of the user may be contra lateral. The motions of the user may mimic walking. The apparatus may include a chair. The apparatus may include a sensor. The sensor may be used to control the apparatus and/or the sensor may be used to adjust the movement regime according to the user. The apparatus may help for example, to mobilize limited mobility users and/or to train healthier habits.

20 Claims, 21 Drawing Sheets

(51) Int. Cl.
*A61H 9/00* (2006.01)
*A63B 21/00* (2006.01)

(52) U.S. Cl.
CPC ..... *A61H 1/0292* (2013.01); *A61H 9/0078* (2013.01); *A63B 21/00178* (2013.01); *A61H 2201/0149* (2013.01); *A61H 2201/0176* (2013.01); *A61H 2201/1207* (2013.01); *A61H 2201/1246* (2013.01); *A61H 2201/1253* (2013.01); *A61H 2201/1664* (2013.01); *A61H 2201/1671* (2013.01); *A61H 2201/501* (2013.01); *A61H 2201/5002* (2013.01); *A61H 2201/5061* (2013.01); *A61H 2201/5071* (2013.01); *A61H 2201/5092* (2013.01); *A61H 2230/625* (2013.01); *A61H 2230/805* (2013.01)

(56) References Cited

U.S. PATENT DOCUMENTS 3,362,090 A * 1/1968 Adam ..... A61H 1/02 434/255
3,641,995 A * 2/1972 Brandt ..... A61H 1/0292 601/26
3,774,597 A * 11/1973 Root ..... A61H 1/0237 601/27
3,824,991 A * 7/1974 Whitaker ..... A47C 9/002 601/5
4,207,879 A * 6/1980 Safadago ..... A61G 13/009 482/142
4,451,086 A * 5/1984 Seven ..... A47C 7/14 297/312
4,612,917 A * 9/1986 Kesler ..... A61H 1/02 601/101
4,796,948 A 1/1989 Paul et al.
4,860,733 A * 8/1989 Parker, Jr. ..... A61H 1/0292 601/24
5,022,385 A 6/1991 Harza
5,024,485 A 6/1991 Berg et al.
5,099,828 A * 3/1992 Duke ..... A61H 1/02 601/26
5,588,704 A 12/1996 Harza
5,695,250 A * 12/1997 Lin ..... A47C 3/18 297/340
5,913,568 A * 6/1999 Brightbill ..... A47C 3/025 297/258.1
5,976,097 A * 11/1999 Jensen ..... A47C 7/024 297/330
6,079,782 A 6/2000 Berg
6,139,095 A 10/2000 Robertshaw
6,592,185 B2 * 7/2003 Lew ..... A61G 15/00 297/217.3
6,592,533 B1 7/2003 Yonekawa et al.
6,685,658 B1 * 2/2004 Dietz ..... A61H 1/0229 128/845
6,866,340 B1 3/2005 Robertshaw
6,893,090 B1 * 5/2005 Van Deursen ..... A47C 7/024 297/312
7,195,583 B2 3/2007 Leib
7,357,768 B2 4/2008 Marshall
7,387,339 B2 6/2008 Bykov et al.
7,452,308 B2 * 11/2008 Robideau ..... A61H 1/02 482/51
8,061,767 B2 11/2011 Kunzler et al.
8,075,057 B2 12/2011 Reingewirtz et al.
8,182,036 B2 * 5/2012 Nishino ..... A47C 3/027 297/258.1
8,249,714 B1 * 8/2012 Hartman ..... A61N 1/36003 607/48
8,845,560 B1 * 9/2014 Hernandez ..... A61H 1/005 297/338
9,480,340 B1 * 11/2016 Harlow ..... A47C 7/543
9,849,328 B1 * 12/2017 Fulks ..... A63B 21/4015
10,130,835 B1 * 11/2018 Leonard ..... A61H 1/0222
2002/0145321 A1 10/2002 Brightbill et al.
2003/0055365 A1 * 3/2003 Hazard ..... A47C 3/0255 601/98
2003/0073552 A1 * 4/2003 Knight ..... A47C 31/126 482/148
2006/0161203 A1 * 7/2006 Endara ..... A61H 1/0292 606/241
2006/0277074 A1 * 12/2006 Einav ..... G16H 10/60 705/3
2007/0273188 A1 11/2007 Morrison
2008/0132383 A1 * 6/2008 Einav ..... A61H 1/02 482/8
2008/0242521 A1 * 10/2008 Einav ..... A61B 5/1116 482/110
2009/0079243 A1 3/2009 Kunzler et al.
2009/0099490 A1 4/2009 Durt et al.
2009/0137369 A1 * 5/2009 Branch ..... A61H 1/0259 482/112
2009/0230743 A1 * 9/2009 Derakhshan ..... A47C 9/002 297/329
2009/0278388 A1 11/2009 Reingewirtz et al.
2010/0313897 A1 * 12/2010 Schaeffer ..... A61H 1/0222 128/845
2011/0275500 A1 * 11/2011 Hur ..... A63B 21/00065 482/142
2012/0298113 A1 * 11/2012 Hruska ..... A61H 1/001 128/845
2013/0005546 A1 * 1/2013 Wang ..... A61H 1/0292 482/142
2013/0005547 A1 * 1/2013 Wang ..... A63B 22/18 482/142
2014/0265460 A1 * 9/2014 Voigt ..... A47C 7/72 297/61
2015/0051520 A1 * 2/2015 Donohue ..... A61H 1/005 601/35
2015/0061336 A1 * 3/2015 Ku ..... A47C 1/023 297/283.2
2016/0051434 A1 * 2/2016 Erkili ..... A61B 5/04888 601/26
2018/0317661 A1 * 11/2018 Lutwak ..... A61H 1/003

FOREIGN PATENT DOCUMENTS

| | | |
|---|---|---|
| JP | 2011-156052 | 8/2011 |
| WO | WO 1991/006274 | 5/1991 |
| WO | WO 98/58568 | 12/1998 |
| WO | WO 01/26508 | 4/2001 |
| WO | WO 03/063650 | 8/2003 |
| WO | WO 03/068114 | 8/2003 |
| WO | WO 2005/074369 | 8/2005 |
| WO | WO 2006/019241 | 2/2006 |
| WO | WO 2007/139365 | 12/2007 |
| WO | WO 2008/133066 | 11/2008 |
| WO | WO 2009/013870 | 1/2009 |
| WO | WO 2015/097701 | 7/2015 |

OTHER PUBLICATIONS

International Preliminary Report on Patentability dated Jul. 7, 2016 From the International Bureau of WIPO Re. Application No. PCT/IL2014/051122.
International Search Report and the Written Opinion dated Jun. 23, 2015 From the International Searching Authority Re. Application No. PCT/ IL2014/051122.
Human Touch "AcuTouch® 9500 Massage Chair", Human Touch® LLC, 2 P., 2011.
Wildman "The Busy Person's Guide to Easier Movement. 50 Ways to Achieve a Healthy, Happy, Pain-Free and Intelligent Body", The Intelleigent Body Press, p. 8-43, 2006.
Yanai et al. "Separating Twists on a Chair", The Feldenkrais Method®: Awareness Through Movement® Lessons, Dr. Moshe Feldenkrais at Alexander Yanai, International Feldenkrais® Federation, 10(Part A): Lessons #451-#457, Jan. 2002.
Communication Pursuant to Article 94(3) EPC dated Mar. 13, 2018 From the European Patent Office Re. Application No. 14831094.9. (5 Pages).

(56) References Cited

OTHER PUBLICATIONS

Communication Pursuant to Article 94(3) EPC dated Nov. 14, 2018 From the European Patent Office Re. Application No. 14831094.9. (5 Pages).

* cited by examiner

APPARATUS FOR STIMULATING SYNCHRONIZED BODY MOTIONS OF A USER

RELATED APPLICATION/S

This application claims the benefit of priority under 35 USC § 119(e) of U.S. Provisional Patent Application No. 61/920,742 filed 25 Dec. 2013, the contents of which are incorporated herein by reference in their entirety.

FIELD AND BACKGROUND OF THE INVENTION

The present invention, in some embodiments thereof, relates to a body support (for example a chair, bed, stander, exerciser and/or seat) that stimulates synchronized body motions of a user and, more particularly, but not exclusively, to a chair that effects contra lateral motions of the shoulders and/or pelvis of the user.

Brightbill (US 2002/0145321) is a seating structure that provides improved comfort and includes a single, pair, or multiple numbers of moving seating assemblies with independent platforms, especially suited for the automotive or aircraft seating environments. A motion mechanism provides each seating assembly with at least one of total rocking, vertical up and down movement, lateral, and limited slight turning movement and in one embodiment generally constrains the seat members of the seat assemblies from interference with each other. The seating assemblies are provided at a neutral angle that corresponds to the particular application of the seat. Independent up and down movement, and rocking, improves seating comfort health, and safety especially as applied to a seating environment, where a user is likely to be seated for an extended period, such as in an automobile or aircraft.

Bykov (U.S. Pat. No. 7,387,339) is a sitting device which would make it possible to efficiently relieve the backbone in a sitting posture taking into consideration individual morphological and functional asymmetries, thereby normalizing the work of other organs and systems of an organism, first and foremost the organs of the small pelvis, optimizing the "torturosity" of the backbone associated with constitutional and geophysical factors. The sitting device comprises a support provided with a base in a top part thereof, on which a seat is mounted; said seat consists of two parts pivotally arranged on a horizontal axis which lies on a frontal plane and is fixed to the base, each part of the seat being provided with adjusters of the rotational motion thereof with respect to the horizontal axis; the device can be provided with a back and a bracket bearing a backrest, comprising two supporting elements pivotally arranged on the horizontal axis which lies on the frontal plane and fixed to the bracket, each supporting element of the backrest being provided with adjusters of the rotational motion thereof with respect to the horizontal axis.

Robertshaw (U.S. Pat. No. 6,139,095) is a split-seat chair that includes a mechanism for stimulation of a person's hips while seated in the chair, by generally simulating the hip motion which occurs during walking, or by allowing such movement by the user. Two platforms under the respective buttocks of the person preferably move in orbital motions about a horizontal axis transverse to the chair, the two pads orbiting 180 degree out of phase relative to one another. The speed of orbital motion is preferably coordinated with the rate of circulation of cerebrospinal fluid in the skull as it travels down into the sacrum. The chair moves the pelvis in a gliding motion that partially mimics walking while the person is seated, thus reducing posturally caused lower back pain and stiffness.

Harza (U.S. Pat. No. 5,022,385) discloses a method and apparatus for periodically and rhythmically lifting first one hip of a seated person and then the other, thereby simulating the muscle stimulation and relaxation imparted to the person through walking while the person is seated. Inflatable air bags provide lift to the seated person while an electric timer and control valve control the timing and distance of inflation.

Additional background art includes: Kunzler (U.S. Pat. No. 8,061,767); Berg (U.S. Pat. Nos. 6,079,782 and 5,024,485); JP 2011156052; Durt (US 2009/0099490); Leib (U.S. Pat. No. 7,195,583); Farber (WO 1998/58568); Harza (U.S. Pat. No. 5,588,704); Bykov (WO 2003/068114); Knight (US 2003/0073552): Van Deursen (WO 2001/26508); Park (WO 2007/139365); Marshall (U.S. Pat. No. 7,357,768); Robertshaw (U.S. Pat. No. 6,866,340); Yonekawa (U.S. Pat. No. 6,592,533); Morrison (US 20070273188); Paul (U.S. Pat. No. 4,796,948); Einav (WO 2005074369); Dr. Moshe Feldenkrais at Alexander Yanai, The Feldenkrais Method, Awareness Through Movement Lessons, The Feldenkrais Institute, Tel Aviv, Israel, 2002 (particularly volume ten #469 pg 3181 and pg 3187); Frank Wildman Ph.D, Busy Person's Guide to Easier Movement Intelligent Body Press, Berkeley, ISBN 1-889618-76-4, 2006 and CN 201019975.

SUMMARY OF THE INVENTION

According to an aspect of some embodiments of the present invention there is provided an apparatus for imparting motion to a user. The apparatus may include one or more seat platforms, one or more backrests, and one or more actuators. The actuators may repeatedly move the one or more seat platforms and the one or more backrests to effect contra lateral shoulder and pelvic motion to the user.

According to some embodiments of the invention, the platforms may include a left platform and a right platform. The actuators may effect a movement of the left platform in a different direction with respect to a movement of the right platform.

According to some embodiments of the invention, the backrests may include a left backrest and a right backrest. The one or more actuators may cause movement of each of the backrests.

According to some embodiments of the invention, the backrests may include a left backrest and a right backrest. The one or more actuators may cause movement of the left backrest in an opposite direction with respect to a movement of the right backrest.

According to some embodiments of the invention, the one or more actuators may impart the motion to mimic a walking motion. In the motion, a left seat platform and a right seat platform may move back and forth at opposite phases. Right and left shoulders supports may move contra laterally in opposite phase from the seat platforms.

According to some embodiments of the invention, each of the platforms may be configured for moving forward while pitching backward and/or moving backward while pitching forward.

According to some embodiments of the invention, the one or more actuators may impart to the one or more backrests movement in a forward and backward direction.

According to some embodiments of the invention, moving the one or more seat platforms and the one or more backrests may impart motions to the user symmetrically over time.

According to some embodiments of the invention, the one or more actuators include a hydraulic actuator.

According to some embodiments of the invention, the hydraulic actuator includes a liquid hydraulic piston, a liquid hydraulic cushion, a pneumatic piston, a motor driven by a pressurized fluid, a pump and/or a pneumatic cushion.

According to some embodiments of the invention, at least one of said platforms may move in an elliptical orbit in the sagittal plane.

According to some embodiments of the invention, the platforms may include a left platform and a right platform and the elliptical orbit of the right platform may be of opposite phase to the elliptical orbit of the left platform.

According to some embodiments of the invention, the one or more actuators are configured to rotate at least one of said platforms around a vertical axis.

According to some embodiments of the invention, the platforms and the backrests may be installed into a chair.

According to some embodiments of the invention, the apparatus may further include a sensor. The movements of the apparatus may be adjusted according to an output of the sensor.

According to some embodiments of the invention, the apparatus may further include a processor. The processor may be configured to activate the actuators according to an output of the sensor.

According to some embodiments of the invention, the apparatus may further include a processor. The processor may be configured to deactivate the actuators according to an output of the sensor.

According to some embodiments of the invention, the processor and the sensor may be configured to provide to the user with a mechanism for consciously controlling the actuators.

According to some embodiments of the invention, the apparatus may be configured as an add-on to an existing article of furniture. For example the existing article of furniture may include an office chair, a wheelchair, a commode, an airplane seat, a driver's seat, a car seat, a bus seat, a train seat, and/or an easy chair.

According to some embodiments of the invention, a component of the apparatus may be connected to the existing furniture using a hook and loop system, Velcro™, a strap, a clamp and/or a hanger hook.

According to some embodiments of the invention, the platforms and backrests may be configured for inducing a motion having at least one therapeutic effect including, for example, reducing a pain of the user, increasing a mobility of the user, stimulating a desirable nervous response, mitigating a disability, and/or increasing a flexibility of the user.

According to an aspect of some embodiments of the present invention there is provided a method for imparting motion to a user. The method may include supporting the user on one or more seat platforms and one or more backrests. The method may further include moving the one or more seat platforms repeatedly with an actuator, and effecting contra lateral shoulder and pelvic motion to the user via the supporting and the moving.

According to some embodiments of the invention, the platforms may include a left platform and a right platform, and the moving may include moving the left platform in a different direction with respect to movement of the right platform.

According to some embodiments of the invention, the backrests may include a left backrest and a right backrest. The method may further include moving of each the backrests.

According to some embodiments of the invention, the moving of the left backrest may be in an opposite direction with respect to the moving of the right backrest.

According to some embodiments of the invention, the motion mimics a walking motion.

According to some embodiments of the invention, the moving of the one or more platforms includes movement in one or more of the following pairs of directions: up and down, forward and backward, pitching forward and backward, and rolling from side to side.

According to some embodiments of the invention, the moving may include rotating an axle to impart an orbital motion to at least one of the platforms. The at least one platform may be connected off center along the axis of the axle.

According to some embodiments of the invention, the method may further include imparting to at least one of the backrests movement in a forward and backward direction.

According to some embodiments of the invention, the moving the one or more seat platforms and the one or more backrests may include imparting motions to the user symmetrically over time.

According to some embodiments of the invention, the moving may include inflating and deflating a pneumatic cushion.

According to some embodiments of the invention, the moving may include moving at least one of said platforms in an elliptical orbit in the sagittal plane.

According to some embodiments of the invention, the platforms may include a left platform and a right platform and the elliptical orbit of the right platform may be of opposite phase to the elliptical orbit of the left platform.

According to some embodiments of the invention, a method of imparting motion may further include rotating at least one of the platforms around a vertical axis.

According to some embodiments of the invention, the supporting may include the user sitting on the one or more platforms.

According to some embodiments of the invention, the method of imparting motion may further include adjusting the moving according to an output of a sensor.

According to some embodiments of the invention, the method of imparting motion may further include activating the actuator according to an output of the sensor.

According to some embodiments of the invention, the method of imparting motion may further include deactivating the actuator according to an output of the sensor.

According to some embodiments of the invention, the method of imparting motion may further include consciously controlling the actuator by the user shifting his position on the seat platforms.

According to some embodiments of the invention, the method of imparting motion may further include installing the one or more platforms and the one or more backrests as an add-on to an existing article of furniture.

According to some embodiments of the invention, the installing may be by means of a hook and loop system, Velcro™, a strap, a clamp and/or a hanger hook.

According to some embodiments of the invention, the method of imparting motion may reduce a pain of the user, increase a mobility of the user, stimulate a desirable nervous response, mitigate a disability, and/or increase a flexibility of the user.

According to an aspect of some embodiments of the present invention there is provided an apparatus for imparting motion to a user. The apparatus may include one or more seat platforms and one or more actuators. The one or more actuators may repeatedly move the one or more seat platforms to effect pelvic motion to the user. The Pelvic motion may include forward motion while pitched backwards and backwards motion while pitched forward.

According to some embodiments of the invention, the platforms may include a left platform and a right platform. The one or more actuators may cause movement of the left platform in a different direction with respect to movement of the right platform.

According to some embodiments of the invention, the one or more actuators may impart motion to mimic a walking motion. For example, a left seat platform and a right seat platform may move back and forth at opposite phases.

According to some embodiments of the invention, the one or more seat platforms and the one or more backrests may impart motions to the user symmetrically over time.

According to some embodiments of the invention, at least one of said actuators may include a hydraulic actuator.

According to some embodiments of the invention, the hydraulic actuator may include a liquid hydraulic piston, a liquid hydraulic cushion, a pneumatic piston, a motor driven by a pressurized fluid, a pump and/or a pneumatic cushion.

According to some embodiments of the invention, at least one of the platforms may move in an elliptical orbit in the sagittal plane.

According to some embodiments of the invention, the platforms may include a left platform and a right platform and the elliptical orbit of the right platform may be of opposite phase to the elliptical orbit of the left platform.

According to some embodiments of the invention, at least one of the actuators may be configured to rotate at least one of the platforms around a vertical axis.

According to some embodiments of the invention, the platforms are installed into a chair.

According to some embodiments of the invention, the apparatus for imparting a motion may further include a sensor, and the movements may be adjusted according to an output of the sensor.

According to some embodiments of the invention, the apparatus for imparting a motion may further include a processor. The processor may be configured to activate at least one of the actuators according to an output of the sensor.

According to some embodiments of the invention, the apparatus for imparting a motion may further include a processor. The processor may be configured to deactivate at least one of the actuators according to an output of the sensor.

According to some embodiments of the invention, the processor and the sensor may be configured to provide to the user with a mechanism for consciously controlling at least one of the actuators.

According to some embodiments of the invention, the seat platforms may be an add-on to an existing article of furniture.

According to some embodiments of the invention, the existing article of furniture may include an office chair, a wheelchair, a commode, an airplane seat, a driver's seat, a car seat, a bus seat, a train seat, and/or an easy chair.

According to some embodiments of the invention, a component of the apparatus may be connected to the existing furniture using a hook and loop system, Velcro™, a strap, a clamp and/or a hanger hook.

According to some embodiments of the invention, the platforms and backrests may be configured for reducing a pain of the user, increasing a mobility of the user, stimulating a desirable nervous response of the user, mitigating a disability, and/or increasing a flexibility of the user.

According to an aspect of some embodiments of the present invention there is provided a method for imparting motion to a user. The method may include supporting the user on one or more seat platforms and moving the one or more seat platforms repeatedly with an actuator. The moving may include moving forward while pitching backward and moving backward while pitching forward.

According to some embodiments of the invention, the platforms may include a left platform and a right platform. The moving may include moving the left platform in a different direction with respect to movement of the right platform.

According to some embodiments of the invention, the motion may mimic a walking motion.

According to some embodiments of the invention, moving the one or more seat platforms may include imparting motions to the user symmetrically over time.

According to some embodiments of the invention, the moving may include inflating and deflating a hydraulic device.

According to some embodiments of the invention, the moving may include moving at least one of the platforms in an elliptical orbit in the sagittal plane.

According to some embodiments of the invention, the platforms may include a left platform and a right platform and the elliptical orbit of the right platform may be of opposite phase to the elliptical orbit of the left platform.

According to some embodiments of the invention, the method of imparting motion may further include rotating at least one of the platforms around a vertical axis.

According to some embodiments of the invention, the supporting may include the user sitting on the one or more platforms.

According to some embodiments of the invention, the method of imparting a motion may further include adjusting the moving according to an output of a sensor.

According to some embodiments of the invention, the method of imparting a motion may further include activating the actuator according to an output of a sensor.

According to some embodiments of the invention, the method of imparting a motion may further include deactivating the actuator according to an output of the sensor.

According to some embodiments of the invention, the method of imparting a motion may further include consciously controlling the actuator by the user shifting his position on the seat platforms.

According to some embodiments of the invention, the method of imparting a motion may further include installing the platforms as an add-on to an existing article of furniture.

According to some embodiments of the invention, the installing may include use of a hook and loop system, Velcro™, a strap, a clamp and/or a hanger hook.

According to some embodiments of the invention, the motion may have a therapeutic effect, for example reducing a pain of the user, increasing a mobility of the user, stimulating a desirable nervous response, mitigating a disability, and/or increasing a flexibility of the user.

According to an aspect of some embodiments of the present invention there is provided an exercise apparatus for stimulating motions of a user. The apparatus may include a seat for seating the user and one or more sensors. The apparatus may also include a processor configured to discern a behavior of the user while seated on the seat from an output of the sensors. The processor may be further configured to interpret an intent of the user from the behavior and to adjust a movement regime according to the intent.

According to some embodiments of the invention, the processor and at least one of the sensors may be configured to provide the user with a mechanism for consciously controlling the apparatus by shifting a posture on the apparatus.

According to some embodiments of the invention, the behavior is a prescribed behavior for conscious control of the apparatus.

According to some embodiments of the invention, the intent includes not wanting to be disturbed due to an involvement in an activity.

According to an aspect of some embodiments of the present invention there is provided an exercise apparatus for stimulating motions of a user. The apparatus may include a seat for seating the user. The seat may be configured for performing a plurality of movement regimes. The apparatus may further include one or more sensors, and a processor. The processor may be configured to discern a health related behavior of the user while sitting on the seat from an output of the sensors and to select a therapeutic movement regime from the plurality of movement regimes according to the behavior.

According to some embodiments of the invention, the behavior may include an unhealthy habit and the movement regime may include an alert informing the user upon performing the behavior.

According to some embodiments of the invention, the behavior may include an unhealthy habit and the therapeutic movement regime may be selected to encourage changing the behavior.

According to some embodiments of the invention, the processor may be configured to activate the apparatus according to the behavior.

According to some embodiments of the invention, the processor may be configured to deactivate the apparatus according to the behavior.

According to some embodiments of the invention, at least one of the sensors may be configured as an add-on to an existing article of furniture.

According to some embodiments of the invention, the seat may be configured as an add-on to an existing article of furniture.

According to some embodiments of the invention, the existing article of furniture may include an office chair, a wheelchair, a commode, an airplane seat, a driver's seat, a car seat, a bus seat, a train seat, and/or an easy chair.

According to some embodiments of the invention, the sensors may include a pressure sensor.

According to an aspect of some embodiments of the present invention there is provided a method stimulating motions of a user. The method may include seating the user on an exercise apparatus and sensing a behavior of the user while seated on the apparatus via one or more sensors. The method may further include processing an output of the sensors. The processing may include discerning a behavior of the user while seated on the apparatus, interpreting an intent of the user from the behavior, and adjusting a movement regime according to the intent.

According to some embodiments of the invention, the behavior may be a prescribed behavior for conscious control of the apparatus.

According to an aspect of some embodiments of the present invention there is provided a method for stimulating motions of a user. The method may include seating the user on an exercise apparatus. The apparatus may be configured for performing a plurality of movement regimes and sensing a behavior of the user via the one or more sensors. The method may also include processing an output of the one or more sensors to discern a health related behavior of the user while sitting on the apparatus and selecting a therapeutic movement regime from the plurality of movement regimes according to the behavior, and performing the movement regime via the apparatus.

According to some embodiments of the invention, the behavior may include an unhealthy habit and the movement regime may include an alert informing the user upon performing the behavior.

According to some embodiments of the invention, the behavior may include an unhealthy habit and the therapeutic movement regime may be selected to train the user to change the behavior.

According to some embodiments of the invention, the behavior may include a posture, flexibility, a state of readiness for the exercise, a habitual posture, a movement, a habitual movement and/or an involvement in another activity.

According to some embodiments of the invention, the method may further include adding the one or more sensors to an existing article of furniture.

According to some embodiments of the invention, the method may further include adding the apparatus to an existing article of furniture.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
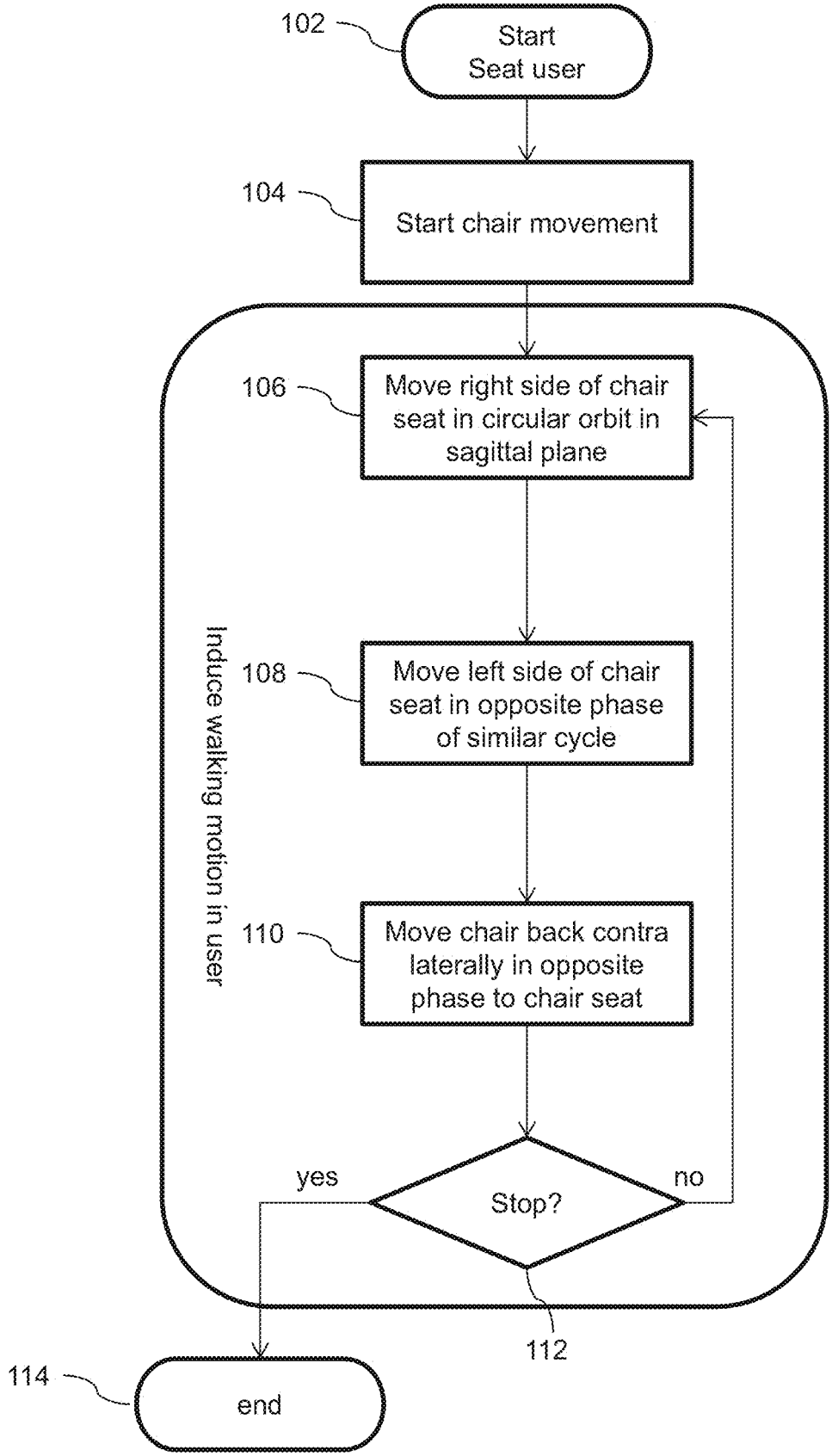
FIG. 1 is a flowchart illustrating an exemplary embodiment of a method of stimulating synchronized body motions of a user in accordance with an embodiment of the current invention.

The present invention, in some embodiments thereof, relates to a body support (for example a chair, bed, stander, exerciser and/or seat) that stimulates synchronized body motions of a user and, more particularly, but not exclusively, to a chair that effects contra lateral motions of the shoulders and pelvis of the user.

Overview

An aspect of some embodiments of the current invention is related to a chair capable of stimulating motions in a user. Optionally the chair seat and backrest will induce contra lateral movements of the pelvis and shoulders of the user. Optionally, movements of the various parts of the seat and seatback may be controlled individually and/or in a synchronized fashion. Optionally, platform or platforms of the apparatus may tilt in a manner synchronized with their movement. For example when a platform is moving forward it may pitch (tilt) backward and/or when it is moving backward it may pitch forward.

Many people spend a long time sitting. Long sessions of sitting may be out of necessity (for example by the disabled) or due to lifestyle choices (for example work, television use, computer use, travel, etc.). According to researchers (for example, van der Ploeg H P, Chey T, Korda R J, Banks E, Bauman A. Sitting Time and All-Cause Mortality Risk in 222 497 Australian Adults. Arch Intern Med. 2012; 172(6): 494-500. doi:10.1001/archinternmed.2011.2174), prolonged stationary sitting can cause physical problems and/or early death. Many problems have been identified that may be associated with prolonged sitting including, for example, posture problems, pressure sores (for the disabled), blood circulation problems, including weakness, muscular and/or skeletal pain (for example in the neck and/or back).

In some embodiments of the current invention, a moving seat may be used by various people including for example one or more of the following:

- disabled people in wheelchairs;
- disabled or ill (for example coma victims or bedridden patients);
- elderly infirm people who spend hours sitting and/or lying;
- people with back pain and/or neck pain;
- people who spend many hours sitting (for example, businessmen, high-tech workers, drivers, passengers on long flights, etc.);
- people who want to train their bodies without effort (for example while watching TV sitting on a chair based on these principles). This training may optionally not be for the sake of building muscle bulk or strength. The training may be, for example, to reduce atrophy, to reduce pain, to increase flexibility, to stimulate changes in movement regimes, to reduce a local pressure, to increase mobility, to stimulate nervous responses, to stimulate reflexive muscle and/or nervous activity and/or to increase circulation. In addition, the training may be used to burn calories, activate the breathing muscles, shape the body (static sitting may cause fattening), move the rib cage, diaphragm (for example by moving the shoulder and hips together) and/or improve posture.

An aspect of some embodiments of the current invention is related to an apparatus for stimulating body movements that may optionally be integrated into and/or added on (permanently and/or temporarily) to a wheelchair, a hospital bed, a reclining chair, a portable seat attachment, a custom chair, a standard design chair, a dynamic executive chair, a car seat, a driver's seat and/or a plane seat.

An aspect of some embodiments of the current invention is related to a moving seat that may optionally be part of a Feldenkrais therapy. According to Moshe Feldenkrais (Awareness Through Movement: Easy-to-Do Health Exercises to Improve Your Posture, Vision, Imagination, and Personal Awareness, HarperCollins, Publishers, 10 East 53rd St. NY, N.Y. 10022, 1977), the Feldenkrais method "is a way for people of every age to integrate physical and mental development into a new, invigorating wholeness. Feldenkrais provides a modern-day, practical program for the perennial ideal of a healthy mind in a healthy body." The method may use, for example, somatic education to stimulate the body to health habits and movements. "Exercises for posture, eyes, imagination and more will simultaneously build better body habits and focus new dimensions of awareness, self-image, and human potential." Stimulation may encourage more healthy movement and/or posture. Additionally and/or alternatively stimulation may arouse natural nervous system responses that promote health.

An aspect of some embodiments of the current invention is related to synchronized movements of the pelvic region and shoulders that may optionally induce motion that involves other joints and muscles. Optionally these other joints and muscles may be in many parts of the body. Optionally synchronized movements may encourage symmetrical loading of body structures. For example, synchronized motions of the pelvis and shoulders may distribute the load along the spine first to one side and then in a symmetrical fashion to the other side. Optionally, the motions may also stimulate beneficial nervous system responses. Optionally, coordinated movements of various body parts may be integrated using a holistic approach. For example, the spine may be stretched and/or rotated and/or relaxed by simultaneous movements of the pelvis and shoulders for example as described herein below. Optionally, multiple joints and/or muscles and/or bones may be activated in a coordinated fashion. For example, a moving seat may generate coordinated motions of the back and/or shoulders and/or pelvis of a user. Optionally, the motions of the user may mimic natural body motions, for example walking. For example, the apparatus may stimulate Sagittal plane pelvis motions (for example, motion like pedaling a bicycle) and coordinated contra-lateral shoulder movements.

An aspect of some embodiments of the current invention is related to an apparatus that may optionally induce movements according to a Feldenkrais regime. Optionally, a chair may have actuators controlled by a processor. The processor may optionally be programmable to move the actuators according to a recorded Feldenkrais session. Examples of appropriate sessions can be found in Dr. Moshe Feldenkrais at Alexander Yanai, The Feldenkrais Method, Awareness Through Movement Lessons, The Feldenkrais Institute, Tel Aviv, Israel, 2002 (particularly for example volume ten #469 pg 3181 and pg 3187). More examples of Feldenkrais regimes may be found in Frank Wildman Ph.D, Busy Person's Guide to Easier Movement Intelligent Body Press, Berkeley, ISBN 1-889618-76-4, 2006 and CN 201019975. Sessions and/or programs may be recorded and/or supplied in computer readable media and/or memory and/or may be transferred over a network. Optionally, sensor data and/or program data and/or control signals may be displayed to a supervisor and/or health professional over an output device and/or may be transferred to a supervisor and/or health professional locally via a wired and/or wireless network.

An aspect of some embodiments of the current invention is related to an apparatus that may optionally include a sensor. A sensor may measure for example weight and/or pressure. Optionally sensor output may be used to detect habitual movements and/or postures of a user. Alternatively or additionally, a sensor may be used to recognize unhealthy movements and/or postures of a user.

An aspect of some embodiments of the current invention is related to a movement apparatus that may optionally help a user develop healthy postures and/or movements. For example, sensors may be used to detect a habitual pattern of movement and/or posture of the user. Optionally, a movement regime may be applied to adjust the habitual patterns.

An aspect of some embodiments of the current invention is related to a movement apparatus that may optionally help a user become aware of postures and/or movements. For example, sensors may be used to detect an unhealthy pattern of movement and/or posture of the user. Optionally, when the unhealthy pattern is detected, a movement regime will be initiated to alert the user of the unhealthy pattern and/or encourage him (For brevity, masculine pronouns are used herein in a non-limiting way. The user may be a male or a female) to change his movement and/or to change his posture.

An aspect of some embodiments of the current invention is related to an apparatus that may optionally include a seat that may rotate around its axis (yaw). For example a platform supporting the pelvis of a user may rotate over a range for example between 0-2 degrees to the right to 0-2 degrees to the left and/or between 2-4 degrees right and 2-4 degrees left and/or between 4-6 degrees right and 4-6 degrees left and/or between 6-10 degrees right and 6-10 degrees left.

An aspect of some embodiments of the current invention is related to an apparatus that may optionally raise and lower the thighs of a user. For example a platform supporting a thigh of a user may be elevated and/or lowered over a range for example between 0 to 3 cm down and 0 to 3 up and/or between 3 to 6 cm down and 3 to 6 cm up and/or between 6 to 9 cm down and 6 to 9 cm up and/or between 9 to 15 cm down and 9 to 15 cm and/or between 15 to 25 cm down and 15 to 25 cm up. Optionally, movement of the left and right thigh may be synchronized. For example, the left thigh may be lowered when the right thigh is raised. Optionally, movement of the thighs may be synchronized with movement of the shoulders and/or pelvis. For example when the right side of the pelvis is moved forward the right thigh may be raised and when the left side of the pelvis is moved forward the left thigh may be raised. Alternatively or additionally when the right side of the pelvis is moved forward the left thigh may be raised and when the left side of the pelvis is moved forward the right thigh may be raised.

An aspect of some embodiments of the current invention is related to a seat that may optionally pitch (tilt forward and/or backwards). For example the front and or back of the seat may rise and/or sink between −5 and 5 mm. Optionally, pitch and yaw movements may be synchronized.

An aspect of some embodiments of the current invention is related to a motion apparatus that may optionally recline. For example, a motion apparatus may in include a chair that reclines at a fixed and/or adjustable angle ranging for example between 90 and 170 degrees.

An aspect of some embodiments of the current invention is related to optionally adjusting the operating speed, and type of movement of a sitting apparatus. For example, control may be by direct manipulation of mechanical parts and/or via a control console and/or via a sensor. For example, a control consol and or a sensor may be mechanical and/or wired and/or wireless. Optionally, control may be via a user device, for example a cell phone, a movement sensor and/or a computer. In some embodiments the control consol may be located for control by the user of the apparatus (for example in a hand rest). Alternatively or additionally, the control panel may be located for control by another person. For example a control consol may be mounted on the back of a chair for use by a doctor and/or nurse and/or other therapist standing behind the apparatus.

An aspect of some embodiments of the current invention is related to an apparatus that may optionally include movable backrests. Optionally the backrests may move in opposite direction (for example to rotate the shoulders of the user in the transverse horizontal plane). Shoulder rotation may for example be in a range between −8 and 8 degrees. Alternatively and or additionally, the outer margins of the seat back may move in the opposite direction of the seatback center (causing for example horizontal abduction and/or adduction of the shoulders).

An aspect of some embodiments of the current invention is related to an apparatus may optionally not be intended to build muscle bulk and may not include heavy exercise. The user may optionally not be making an effort but rather learning a new movement regime. Optionally, there may not be large forces between the machine and the user, only gentle encouraging motions. In some embodiments, the rate of movement may range, for example, from a rate of running to a rate of leisurely walking, for example, a repeated or cyclical movement may have a period of between 2 and 10 seconds.

An aspect of some embodiments of the current invention is related to a movement apparatus that may optionally not include a sensor and/or a processor. Optionally, movements may be fixed, not changing in response to the user. Optionally, a motion stimulating apparatus may not be motorized. For example, a motion apparatus may have moving parts and a sitting person may cause the movements manually. Optionally, there may be a resistance to manual movements, for example with springs, weights, and/or magnets. In some embodiments, the user of the device may supply power to the device, for example via pedals.

An aspect of some embodiments of the current invention is related to use of a rehabilitation apparatus. Optionally the apparatus encourages therapeutic movements and/or sets of coordinated movements. For example, the apparatus may encourage movement patterns. For example the apparatus may encourage movement patterns to which a user was accustomed when he was healthy user for example before an illness. Optionally the apparatus encourages movements to a user while the user remains in a supported posture, For example, the apparatus may encourage movements while the user is sitting and/or lying down and/or reclining. In some embodiments the apparatus may train a user to perform healthy and/or useful coordinated movements. For example, a user may include post-stroke patients; Lower limb amputees; people suffering from traumatic brain injury and/or Parkinson's disease and/or spinal cord injury and/or Multiple Sclerosis and/or slipped disk and/or lower back pain; people recovering from surgery and/or people recovering from an injury; and/or the elderly. In some embodiments the apparatus may encourage movements mimicking walking and/or another customary movement pattern and/or a hereditary movement pattern.

In some embodiments of the current invention an apparatus may encourage movements mimicking full body walking motion. For example walking motion may include synched contra-lateral motion of a torso, a pelvic ring, arms, shoulders and/or legs. For example, in a walking motion, when the right leg steps forward, the right hip joint may move forward and/or the right shoulder may move backwards and/or the left shoulder may move forward. When the left legs steps forward, the movements may be the same with the sides reversed (counter-side organs). In a healthy person, the walking pattern may be automatic.

A patient who was once used to walking may be in a process of regaining the ability to walk. For such a patient, triggering the walking pattern may be highly therapeutic. In some cases it may be important, to avoid creating a new, wrongful walking pattern which might cause new problems such as asymmetry, over use of certain muscles and/or joints and/or underutilization of other muscles and/or joints and/or cause walking difficulties and/or orthopedic problems for example including leg and/or back pain. In some embodiments a devices according to the current invention may activate the torso, and/or the legs and/or the arms and/or the shoulders. Movements of individual organs and/or groups of organs may include a specific sequence of movements and/or movements in a coordinated manner, for example mimicking a walking pattern.

An aspect of some embodiments of the current invention relates to encouraging therapeutic movement patterns while sitting. In some embodiments, the walking pattern may be stimulated while a patient is sitting. For example, it may be therapeutic to encourage walking movements while sitting for a patient who is extremely limited in walking his ability to walk (for example a patient may be limited in the distance that he can practice movements while walking. For example some, some patients are limited to walking less than 4 continuous steps and/or 4 to 10 continuous steps and/or 10 to 20 continuous steps. For example some, some patients are limited to continuous walking less than 4 meters and/or between 4 to 10 meters and/or between 10 to 20 meters. For example some, some patients are limited to continuous walking less than 10 seconds and/or between 10 to 30 seconds and/or between 30 to 120 seconds. The ability to sit is a broad common denominator of many walking rehab patients including severe ones. For many patients sitting requires little effort. For many rehab patients it is possible to sit for long periods of time. Optionally, encouraging walking motions in a sitting person may allow longer and/or more continuous and/or more consistent sessions of movement than would be practiced if the exercises were performed while actually walking and/or standing. In some embodiments, encouraging walking movements while sitting will help a patient learn to perform the movements in a relaxed manner and/or without fear of falling.

In some embodiments contra lateral movements may be produced by a stander device (for example a bed that rotates between horizontal, slanted and/or vertical positions such as supine, Fowler and/or Trendlenburg positions) and/or a harness. In some embodiments contra lateral movements may be produced by a device for assisted standing and/or walking.

Optionally a motor may be used to produce movement and/or be activated by a switch. Alternatively or additionally movements may be motor assisted (for example moving one or more limb may activate a motor that powers further movement and/or movement of other limbs). Alternatively or additionally movements may be manual, for example wherein force by one or more limbs is translated into an organized movement of those limbs and/or other limbs. Alternatively or additionally there may be a fixed and/or adjustable resistance and/or assistance to movement of one or more limbs.

In some embodiments, the user's pelvis may remain parallel to the floor and/or horizontal and/or supported while the pelvis and/or other body parts are being moved and/or rotated. This may, for example, bestow a feeling of confidence to a patient and/or may avoid undermining the patient's balance (fear of falling) when the device is activated and moves the patient's body.

Some embodiments may include moving the upper limbs and/or shoulders. Optionally movement may is provided by handgrips. For example the movements may be similar to walking with Nordic walking sticks. This movement may, for example activate the extensor muscles and/or contribute to a healthy and poised walking and/or improve the user's posture. These improvements may be achieved, for example, even when the user is sitting.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Exemplary Embodiments

An Exemplary Method

FIG. 1 is a flow chart illustration of an exemplary method of mobilizing a person in accordance with an embodiment of the current invention. The method may optionally include an exercise including movements that may be similar to walking. For example a user's hips may be moved in circular orbits in the Sagittal plane in opposite phases (like pedaling a bicycle) while the user's shoulders move contra laterally and in opposite phase from the hips (for example when the left hip is moving forward, the left shoulder may be moving backward).

In some embodiments, a method of stimulating synchronized body motions may start by seating 102 the user in a mobilizing apparatus. Optionally seating the user may include various forms of being partially and/or completely supported by the apparatus, for example lying down on the apparatus, sitting on the apparatus, kneeling on the apparatus, etc. Optionally the user may start movement 104 of the chair. For example he may push a button on a user interface.

In some embodiments, the chair seat may have a left and a right platform. Optionally the right platform may move 106 in a circular orbit in the Sagittal plane. Optionally the left platform may simultaneously move in the Sagittal plane in an opposite 108 phase.

In some embodiments, the chair back may move contra laterally 110 and in opposite phase from the hips. For example, when the right hip is moving forward, the right shoulder may simultaneously be moving backwards and the left hip may be simultaneously moving backward and the left shoulder may simultaneously be moving forward. Optionally, all or some of the movement may be continuous and/or there may be pauses.

In some embodiments, similar movements may continue until the user deactivates 112 the device using the user interface. Optionally, after turning off the machine, the user may end 114 the session.

An Exemplary Two Platform Seat (Rollers and Motor)

Figure 2A:
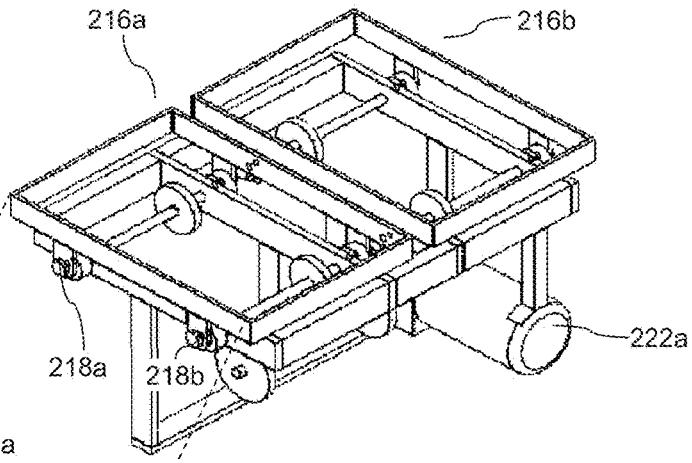
FIG. 2A is a perspective view an exemplary embodiment of a two platform apparatus for stimulating synchronized body motions of a user in accordance with an embodiment of the current invention.
Figure 2A:
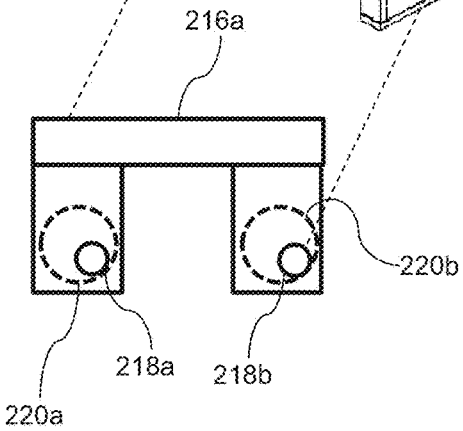
Figure 2B:
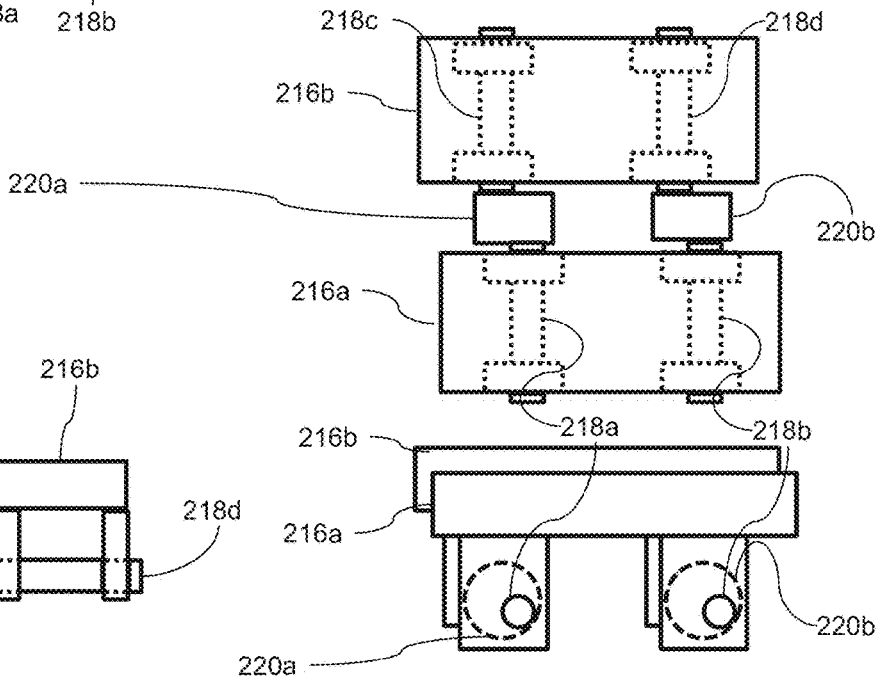
FIG. 2B is schematic view of three orthogonal projections of an exemplary mechanism of a two platform apparatus for stimulating synchronized body motions of a user in accordance with an embodiment of the current invention.
Figure 2B:
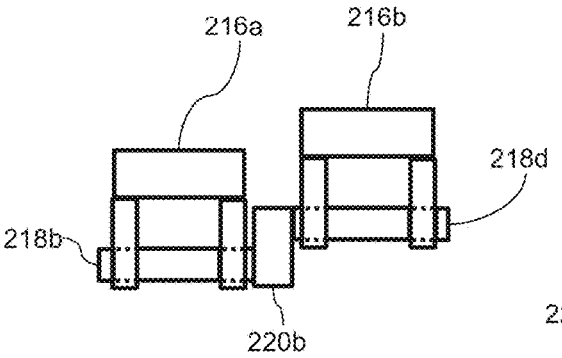

FIG. 2A shows a perspective view a chair having two seat platforms and a motor for driving them in accordance with an embodiment of the current invention. FIG. 2B shows three schematic orthogonal projections of the seat platforms.

In some embodiments, a seat for a user may include two side by side platforms. Optionally the platforms may be mounted on an actuator that moves the platforms in a synchronized manner. For example the actuator may move the platforms forward and backward. Alternately or additionally, the platforms may move up and down. Optionally, the platforms may pitch (tilt) forward and backwards. Pitching forward and backward may optionally be free, and/or synchronized to the moving forward and backward and/or synchronized to the up and down movement. For example, one platform may pitch backwards as it moves downward and forward while the other platform pitches forward as it move upward and backward. In some embodiments, the two platforms may support a single seat cushion. Alternatively or additionally, each platform may support a separate cushion.

In some embodiments, two platforms 216*a,b* may be mounted on pins 218*a,b,c,d* which may spin freely with respect to platforms 216*a,b*. Optionally, pins 218*a,b,c,d* may be fixed off center along the axes of respective axles 220*a,b*. Optionally, when axles 220*a,b* spin, platforms 216*a,b* may move in circular orbits. Optionally, pins 218*a,b* of left platform 216*a* may be fixed to axles 220*a,b* in an opposite phase from pins 218*c,d* of right platform 216*b*. For example, in FIG. 2A, pins 218*a,b* are shown in the 5:00 position while pins 218*b,c* are in the 11:00 position. Thus, in the example platform 216*a* is below and behind platform 216*b*. Optionally, a motor 222*a* may drive axles 220*a,b* thereby driving platforms 216*a,b* in circular orbits.

In the exemplary embodiment of FIGS. 2A and 2B, pins 218*a* and 218*b*, which support the front and back respectively of platform 216*a*, are fixed at the same position on their respective axles 220*a,b* (both pins 218*a* and 218*b* are at the 5:00 position and they are both at the same radial distance from the center of their respective axles 220*a,b*). In the exemplary embodiment of FIGS. 2A and 2B, axles 220*a* and 220*b* rotate at the same speed. In the exemplary embodiment of 2A and 2B platforms 216*a,b* both remain horizontal throughout their movement regime.

An Exemplary Seat with a Back

Figure 2C:
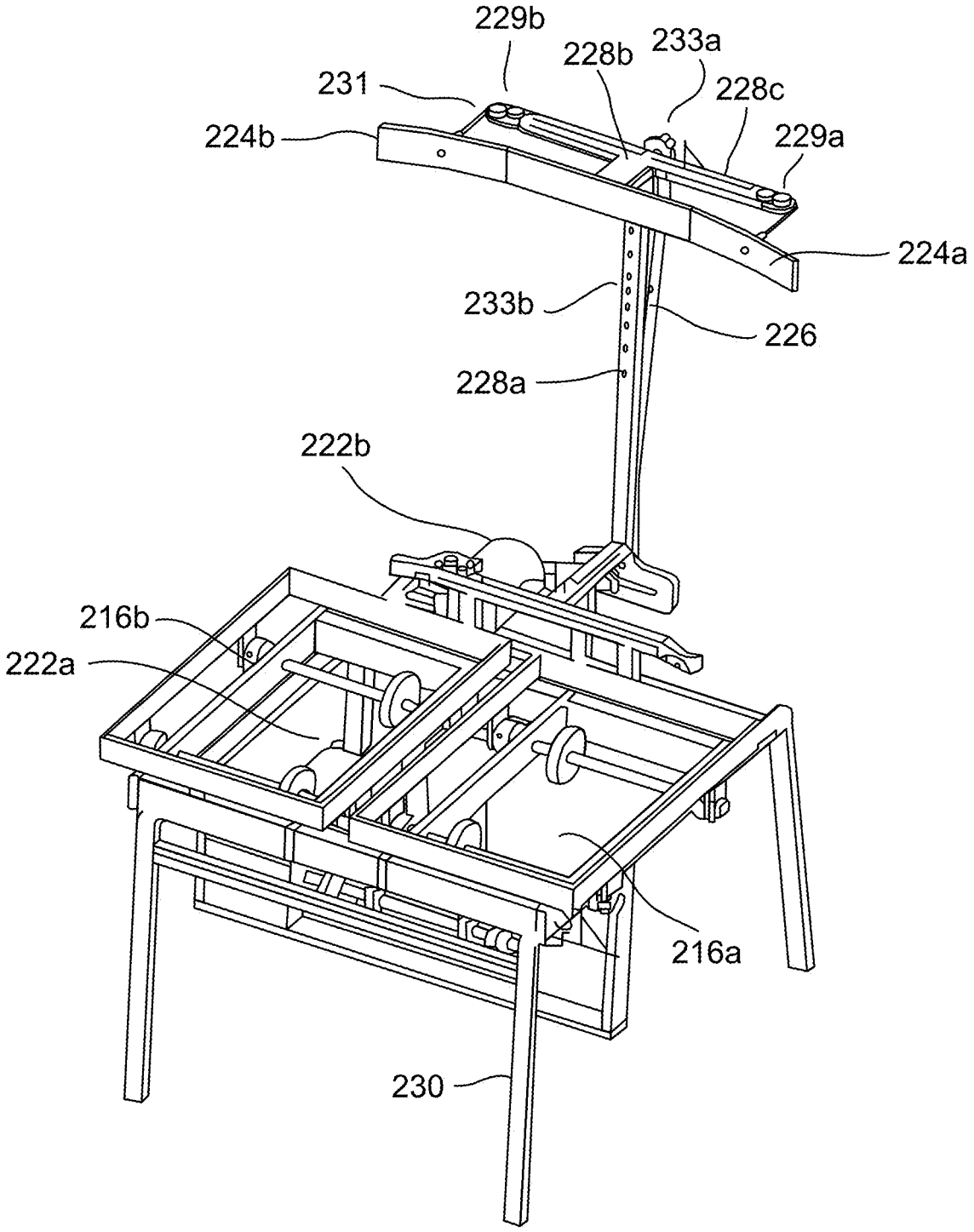
FIG. 2C is a perspective view of an exemplary embodiment of a two platform chair and moving backrest for stimulating synchronized body motions of a user in accordance with an embodiment of the current invention.

FIG. 2C illustrates a chair 230 including seat platforms 216*a,b* in accordance with an embodiment of the current invention. In the exemplary embodiment, chair 230 also includes two moving back supports 224*a,b*. Optionally, back supports 224*a,b* move forward and backwards. For example, as illustrated in the exemplary embodiment of FIG. 2C, moving back supports 224*a,b* move in opposite phase to seat platforms 216*a,b*. For example, when left seat platform 216*a* moves backwards, left back support 224*a* moves forward and vice versa. In the example, left and right seat platforms 216*a,b* move in opposite phase; when left seat platform 216*a* moves forward, then right seat platform 216*b* and left back support 224*a* move backward; when left seat platform 216*a* moves backward, then right seat platform 216*b* and left back support 224*a* move forward and vice versa.

Exemplary Embodiments of Seat Back Mechanisms

In the exemplary embodiment of FIG. 2C, back supports 224*a,b* are on opposite sides of a spring steel member. Optionally, the spring steel member is shaped so that back supports 224*a,b* are biased forward. Optionally the center of the spring steel member is held rigidly by a support bars 228*a,b*. In the exemplary embodiment each of back supports 224*a,b* is connected to one end of a cable 231. In the exemplary embodiment, cable 231 runs along horizontal bar 228*c* and around two guide wheels 229*a,b*.

In some embodiments, a lever arm 226 may tilt left or right, pivoting around a bolt 233*b*. Optionally, the top of lever arm 226 is attached to by a bolt 233*a* to the center of cable 231. Optionally, tilting lever arm 226 shifts cable 231. For example, when lever arm 226 tilts leftward (as illustrated in FIG. 2C), it shifts cable 231 leftward allowing left back support 224*a* to move to its forward biased position and pulling right back support 224*b* backwards; when lever arm 226 tilts rightward, it shifts cable 231 rightward allowing right back support 224*b* to move to its forward biased position and pulling left back support 224*a* backwards. Optionally a motor 222*b* may tilt lever arm right and left causing contra-lateral shoulder movements. Alternatively or additionally, a transmission mechanism may be supplied to allow motor 222*a* to drive lever arm 226. An exemplary embodiment of the mechanism for moving back supports 224*a,b* is shown in FIGS. 2D-2F.

Figure 2D:
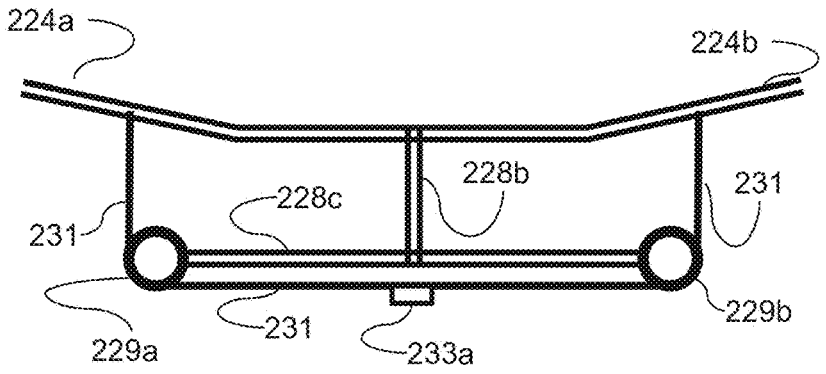
FIGS. 2D and 2D' are top and a rear views respectively of an exemplary embodiment of a mechanism for contra lateral shoulder movement, illustrated in a centered position (both shoulders equal) in accordance with an embodiment of the current invention.
Figure 2D:
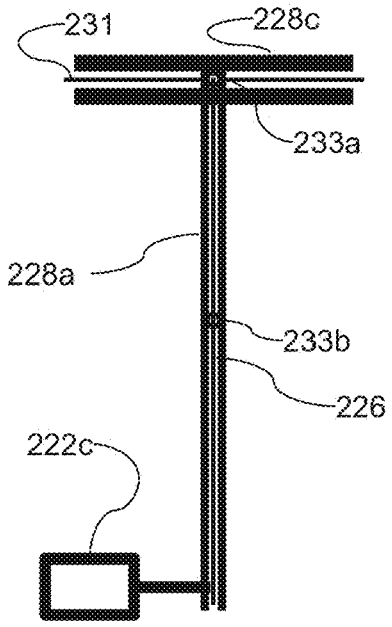
Figure 2E:
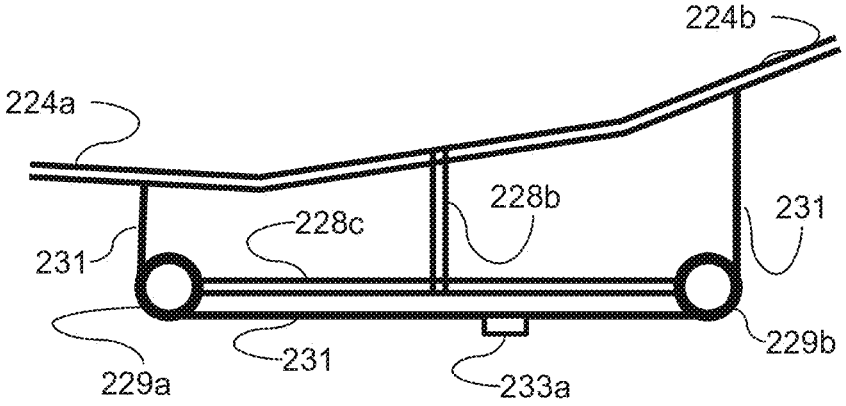
FIGS. 2E and 2E' are top and a rear views respectively of an exemplary embodiment of a mechanism for contra lateral shoulder movement, illustrated with the right shoulder forward and the left shoulder back in accordance with an embodiment of the current invention.
Figure 2E:
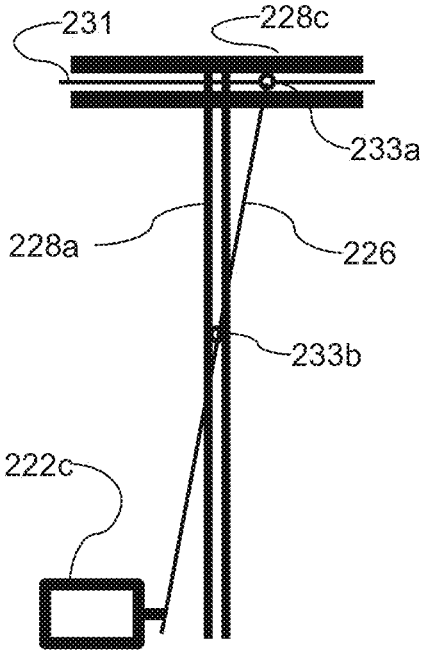
Figure 2F:
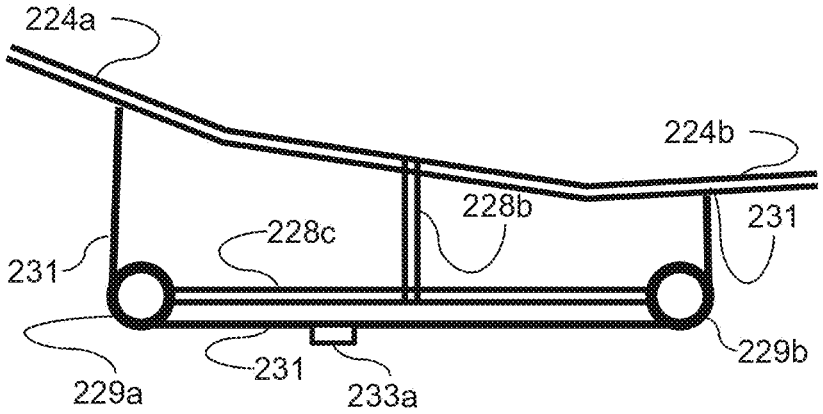
FIGS. 2F and 2F' are top and a rear views respectively of an exemplary embodiment of a mechanism for contra lateral shoulder movement, illustrated with the right shoulder back and the left shoulder forward in accordance with an embodiment of the current invention.
Figure 2F:
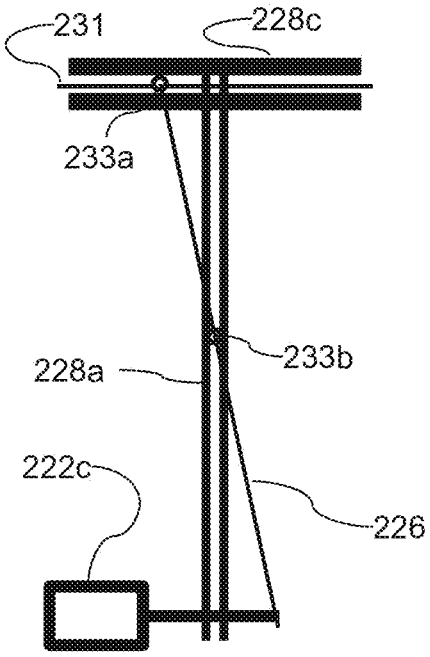

FIGS. 2D-2F' illustrate schematically a mechanism to move shoulder supports 224*a,b* contra laterally with respect to each other in accordance with an embodiment of the current invention. FIGS. 2D and 2D' illustrate a top view and a rear view respectively of an example wherein supports 224*a,b* are extended equally. FIGS. 2E and 2E' illustrate a top view and a rear view respectively of an example wherein left support 224*a* is retracted backward and right support 224*b* is extended forward. FIGS. 2F and 2F' illustrate a top view and a rear view respectively of an example wherein left support 224*a* is retracted backward and right support 224*b* is extended forward.

In the example of FIG. 2E, 2E', actuator 222*c* retracts its piston arm pulling the bottom of lever arm 226 leftward. Lever arm 226 pivots around bolt 233*b* moving the top of arm 226 in the opposite direction (rightward). In the example of FIGS. 2E, 2E', lever arm 226 pushes bolt 233*a* and cable 231 rightward. In the example of FIGS. 2E,2E', shifting cable 231 rightward pulls left back support 224*a* backwards and allows right back support 224*b* to move forward according to its spring biasing.

In the example of FIG. 2F, 2F', actuator 222*c* extends its piston arm pushing the bottom of lever arm 226 rightward. Lever arm 226 pivots around bolt 233*b* moving the top of arm 226 in the opposite direction (leftward). In the example of FIGS. 2F,2F', lever arm 226 pushes bolt 233*a* and cable 231 leftward. In the example of FIGS. 2F,2F', shifting cable 231 leftward pulls right back support 224*b* backwards and allows left back support 224*a* to move forward according to its spring biasing.

In some embodiments, the magnitude of movements may be adjusted by direct mechanical manipulation of the apparatus. For example bolt 233*b* may serve as the fulcrum of lever arm 226. Optionally moving bolt 233*b* upward may reduce the ratio of the lengths of the top and bottom portions of lever, reducing the movement of bolt 233*a* with respect to motor 222*b* and/or actuator 222*c*. This may for example reduce the magnitude of movements of shoulders supports 224*a,b* or 224*c,d*.

Figure 2G:
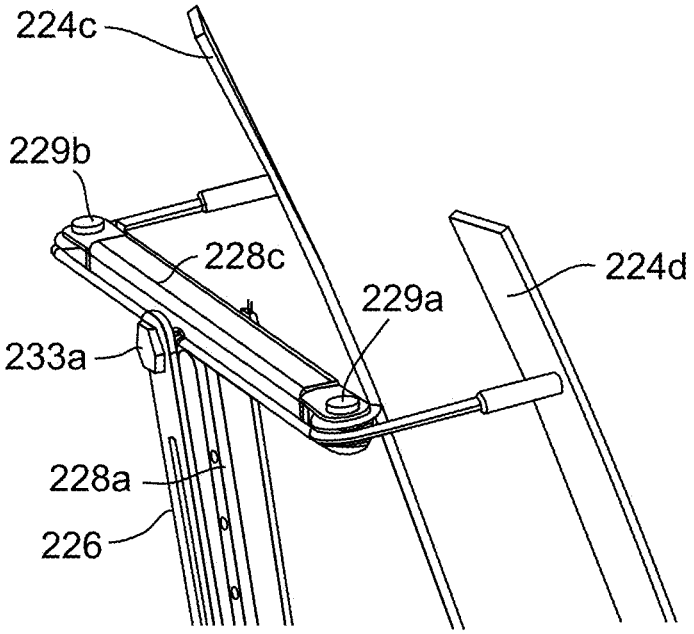
FIGS. 2G and 2G' are perspective top and front views respectively of an exemplary embodiment of a seat back mechanism in accordance with an embodiment of the current invention.
Figure 2G:
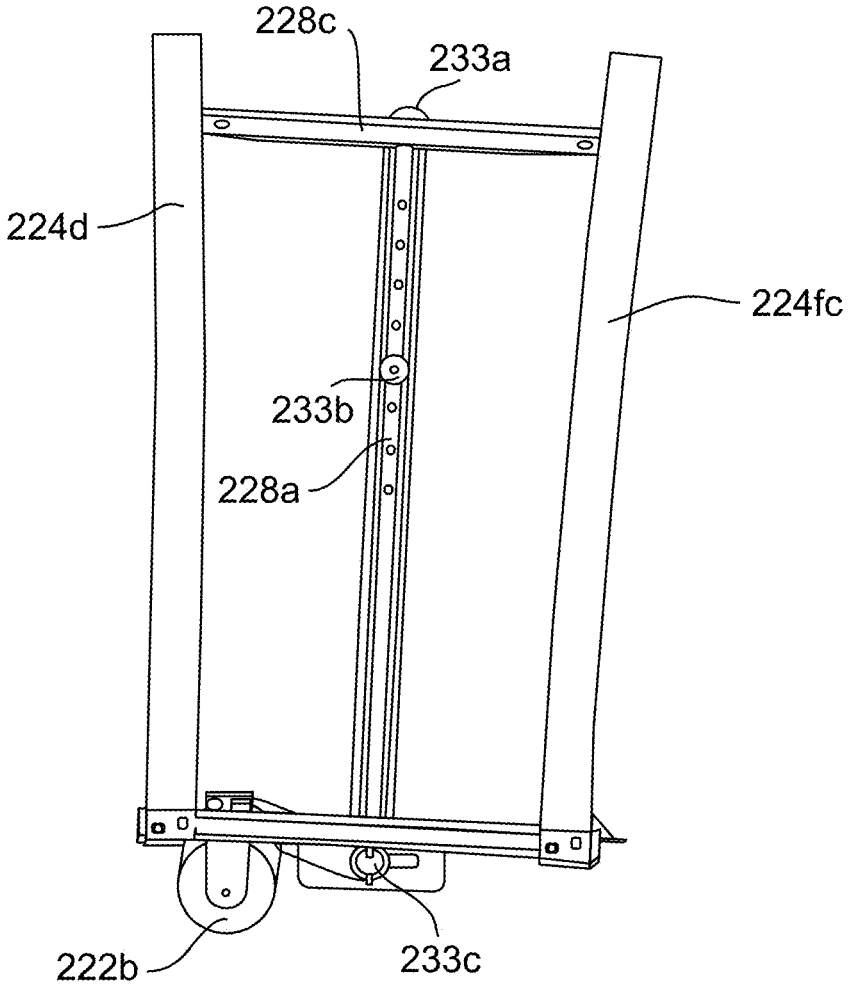

FIGS. 2G and 2G' illustrate perspective top and front views respectively of a seat back mechanism in accordance with an embodiment of the current invention. Many parts in the exemplary embodiment of FIGS. 2G, 2G' are similar to those of 2C-2F. In the exemplary embodiments of FIGS. 2F, 2F', two back supports 224*c* and 224*d* are upright leaf springs held rigidly from below and biased forward at their upper end. Depending on the position of lever arm 226, cable 231 optionally pulls back one of supports 224*c,d* and allows the other to move forward. In the exemplary embodiment of FIGS. 2G, 2G', contra lateral movement of shoulder supports 224*c,d* are driven by a motor 222*b*.

An Exemplary Seat Platform Including a Non Circular Orbit

Figure 3A:
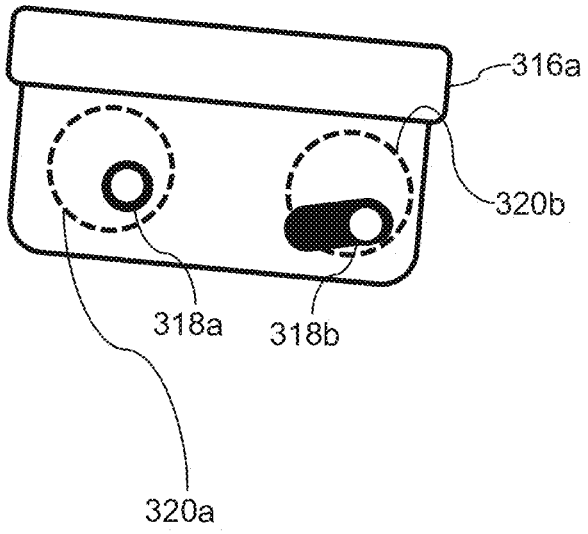
FIG. 3A is a view of an exemplary embodiment of a mechanism that causes a platform to pitch forward and backward in accordance with an embodiment of the current invention.
Figure 3B:
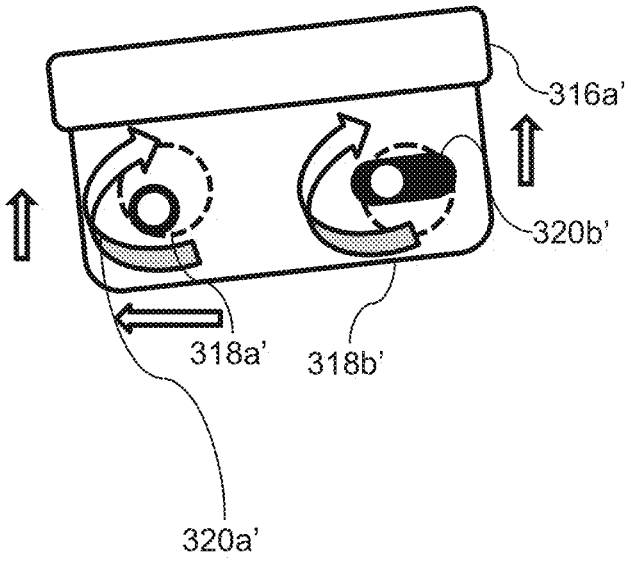
FIG. 3B is a view of another exemplary embodiment of a mechanism that causes a platform to pitch forward and backward in accordance with an embodiment of the current invention.

FIGS. 3A and 3B show two mechanisms that cause seat platforms to pitch forward and backward in accordance with some embodiments of the current invention. Optionally, the pitching forward and backward may be synchronized to translation forward and backward and/or translation upward and downward.

In the exemplary embodiment of FIG. 3A, two pins 318*a,b* may be fixed at different radial distance from the center of the axis of their respective axles 320*a,b*. Optionally, axles 320*a* and 320*b* may revolve at the same rate. Optionally, front pin 318*a* supporting the front of platform 316*a* is fixed at a smaller radius than rear pin 318*b* supporting the rear of platform 316*a*. In the exemplary embodiment of FIG. 3A up and down movements of the rear of platform 316*a* have a greater magnitude than up and down movements of the front of platform 316*a*. Optionally, the difference in magnitude of up and down movements between the front and rear of platform 316*a* causes platform 316*a* to pitch upward and downward.

In the exemplary embodiment of FIG. 3A, platform 316*a* is mounted on pin 318*a* with a snugly fitting hole. In the embodiment of FIG. 3A, forward-backward translation of platform 316*a* are according to the movement of pin 318*a*. Optionally, the hole of pin 318*b* is elongated allowing pin 318*b* to slide along the elongated hole when the distance between pins 318*a,b* changes.

In the exemplary embodiment of FIG. 3B, two pins 318*a*',b' may be fixed at different phases on respective axles 320*a*',b'. Optionally, axles 320*a*' and 320*b*' may revolve at the same rate. In the exemplary embodiment of FIG. 3B up and down movements of the rear of platform 316*a*' have a different phase than the up and down movements of the front of platform 316*a*'. Optionally, the difference in phase of up and down movements between the front and rear of platform 316*a*' cause platform 316*a*' to pitch upward and downward.

In the exemplary embodiment of FIG. 3B, platform 316*a*' is mounted on pin 318*a*' with a snugly fitting hole. In the embodiment of FIG. 3A, forward-backward translation of platform 316*a*' are according to the movement of pin 318*a*'. Optionally, the hole of pin 318*b*' is elongated allowing pin 318*b*' to slide along the elongated hole when the distance between pins 318*a*',b' changes.

In some embodiments, for example in either of the embodiments of FIG. 3A or 3B, two axles (for example the set of axles 320*a* and 320*b* and/or the set of axles 320*a*' and 320*b*') may rotate at different speeds.

In some embodiments a user may be able to adjust aspects of the seat and/or seatback movement. For example, optionally a user may be able to adjust the phase difference between platforms 216*a* and 216*b*. For example platform 216*a* may move in phase with platform 216*b*. Optionally a user may be able to change the position of pins 318*a* and/or 318*b*. Optionally, a user may be able to change the phase of pins 318*a*' and/or 318*b*'. Optionally, in some cases a user may adjust both the position and phase of pins to cause larger or smaller magnitude of movement of the front and/or back of a platform and/or change the coordination of those movements in the general movement regime.

An Exemplary Embodiment Including a Seat Back

Figure 3C:
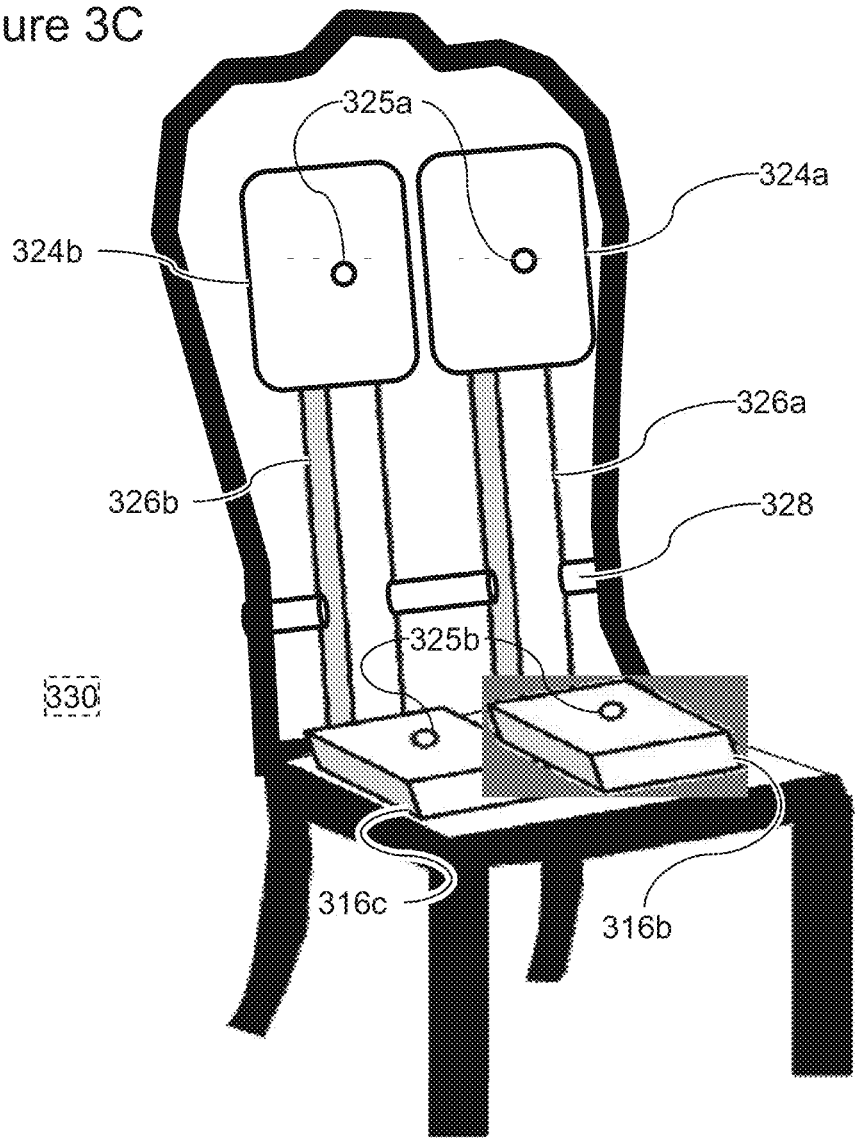
FIG. 3C is a perspective view of an embodiment of a two platform system add-on to a standard chair in accordance with an embodiment of the current invention.

FIG. 3C illustrates a standard chair 330 including seat platforms 316*b,c* in accordance with an embodiment of the current invention. The exemplary embodiment, of FIG. 3C also includes two moving backrests 324*a,b*. Optionally, backrests 324*a,b* move forward and backwards. For example, as illustrated in the exemplary embodiment of FIG. 3C, backrests 324*a,b* move contra laterally and in opposite phase with regards to seat platforms 316*b,c*. For example, when left seat platform 316*b* moves backwards, left backrest 324*a* moves forward and vice versa. In the example, left and right seat platforms 316*b,c* move in opposite phase; when left seat platform 316*b* moves forward, then right seat platform 316*c* and left backrest 324*a* move backward; when left seat platform 316*b* moves backward, then right seat platform 316*c* and left backrest 324*a* move forward and vice versa. Optionally, platforms 316*b,c* may move forward and backwards while remaining at equation heights. In some embodiments, keeping platforms 316*b.c* at the same height may keep the pelvis of the user parallel to the floor and/or horizontal.

In the exemplary embodiment of FIG. 3C, left and right backrests 324*a,b* are mounted on pivoting supports 326*a,b* respectively. Optionally, pivoting supports 326*a,b* pivot around a support rod 328. Optionally, when right seat platform 316*c* moves backward, it pushes the bottom of support 326*b* backward. For example, pushing the bottom of support 326*b* backward causes support 326*b* to pivot around rod 328 causing the top of support 326*b* and backrest 324*b* to move forward. In the exemplary embodiment, backrest 324*a* moves in a similar manner as backrest 324*b*, but in opposite phase. Alternatively or additionally, there may be a single cushion that is supported on one side by support 326*a* and that is supported on the other side by support 326*b*.

Some embodiments of an apparatus for stimulating synchronized body motions of a user may include a sensor. For example, the embodiment of FIG. 3C includes four pressure sensors 325*a,b*. Optionally, the output of sensors 325*a,b* may be used to adjust the exercise regime. For example when the ratio of pressure on the sensor 325*b* of a raised platform (of platforms 316*b,c*) with respect to pressure on the sensor 325*b* of the lowered platform is greater than a threshold, then it may be a sign that the spine of the user is not flexible enough. Optionally, when the spine is not flexible enough, the movement regime may be adjusted by reducing the magnitude and/or the rate of vertical movements of platforms 316*b,c*. Additionally or alternatively, if there is much more pressure on the sensor 325*a* of the forward backrests 324*a,b* than on sensor 325*a* of the backward backrest 324*a,b*, then it may a sign the spine of the user is not flexible enough. Optionally, the magnitude and/or the rate of movements of backrest 324*a,b* may be reduced. Optionally, the sensors may be used to track a user's exercise. Optionally a memory and/or processor may be provided. For example, the processor and memory may be used to store sensor output and/or process sensor output and/or compute statistics. For example, after a session, the processor may report to a user, a trainer and/or record that his right leg moved 20% on average easier than his left leg. Optionally, the processor may also collect sensor data when active movement is not occurring. For example, once an hour the processor may report how much he was leaning on each side, whether he was sitting motionless or moving, how much he was sitting on the front or the back of the chair, whether he was slouching etc. The data may be used for example to schedule and/or adjust a custom exercise regime for the user.

An Exemplary Hydraulic One Platform Seat and Back with Air Cushions

Figure 4A:
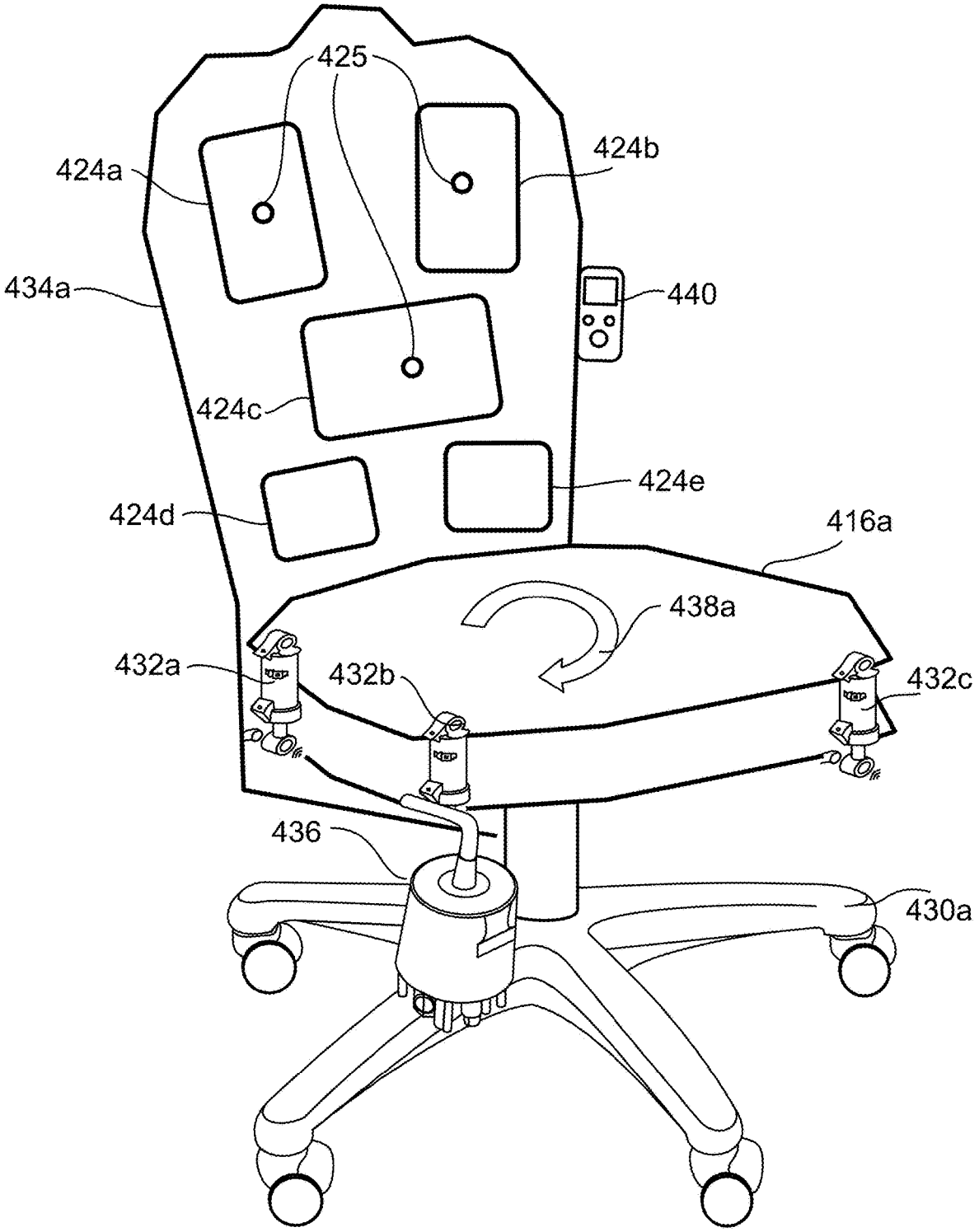
FIG. 4A is a schematic perspective view of an exemplary embodiment of an add-on single platform apparatus for stimulating synchronized body motions of a user installed into a standard office chair in accordance with an embodiment of the current invention.

FIG. 4A illustrates an add-on apparatus for stimulating synchronized body motions of a user in accordance with an embodiment of the current invention. The embodiment of FIG. 4A uses hydraulic means to cause synchronized movements of the shoulder and pelvis of a user. Optionally, the hydraulic fluid may include oil, water or another liquid. Alternatively or additionally the hydraulic fluid may include a gas (pneumatic system), for example air.

In the exemplary embodiment of FIG. 4A, the movement system is installed onto an office chair 430*a*. The system includes five inflatable backrests 424*a,b,c,d,e* and four pneumatic pistons 432*a,b,c* (a fourth piston on the far corner is not seen in the illustration). The system optionally includes a single seat platform 416*a* which can be raised, lowered and/or tilted by a set of four pneumatic pistons 432*a,b,c*. Pressure may be supplied for example by a pump 436. In the example, valves (not shown) are opened and closed by a controller installed into a control unit 440.

In some embodiments, the controller may independently control the various backrests 424*a-e* and/or pistons 432*a-c* to tilt a user's pelvis (for example changing pitch and/or roll) and/or twist and/or bend his back in any direction. For example, inflating backrests 424*c* while deflating backrests 424*a,b* may cause shoulder adduction. Inflating backrests 424*a,b* while deflating backrest 424*c* may cause should abduction. Backrests 424*d,e* may optionally be provided to push each side of the back of the pelvis of the user. For example, pushing on the sides of the pelvis of the user may supplement the rotating motion of the seat (for example encouraging twisting movement of the pelvis and preventing the platform from slipping under the user). For example, deflating backrests 424*a,b,d,e* together while inflating backrest 424*c* may cause the user to arch his back and roll his pelvis forward. For example, inflating backrests 424*a,b,d,e* together while deflating backrest 424*c* may cause the user to flexion his back and roll his pelvis backward. In some embodiments, lower back backrests may cause the pelvis to rotate without the rotating the seat platform. Optionally platform 416*a* and/or the pelvis of the user may be kept parallel to the floor and/or horizontal. For example, keeping the pelvis parallel to the floor may help the confidence and sense of balance of some users.

In some embodiments, an apparatus for stimulating synchronized body motions of a user may include sensors. For example, pressure sensors 425 may help determine the flexibility, size, posture and/or weight of a user. Optionally, according to the output of sensors 425 the rate and/or magnitude and/or regime of movement may be adjusted. Alternatively or additionally, sensors may optionally serve as to adjust actions of a chair according to the user's current posture and/or preferences. For example, sensors may be used to determine if the user is in a posture which would benefit from movement of the chair, and/or if he is in a posture that indicates that he might not want to be bothered by movements of the chair right now, and/or the user may control the chair by changing his posture. There may optionally be prescribed postures and/or movements. The prescribed postures and/or movements may optionally have set meanings, known to the user. Optionally, the user may consciously control the apparatus by adopting a posture and movement. For example, leaning hard on one armrest may be a sign not to start a movement regime. Optionally, when the user desires to prevent a movement regime from starting he may lean on the armrest. Alternatively and additionally the prescribed postures and/or movements may be programmable, for example by the user. Alternatively and additionally the meaning of the prescribed postures and/or movements may be programmable, for example by the user. Some non-limiting examples of uses of sensors are illustrated below for example in the description of FIG. 9.

In some embodiments a system may include a motor (for example a DC motor, a brushless actuator and/or a pneumatic motor). Optionally, a motor may be controlled by the controller. For example, a motor may swivel platform 416*a* and/or a seat back 434*a* individually and/or in a synchronized manner (for example changing the yaw angle). For example, the users' pelvis may be rotated and/or tilted in a manner synchronized with movements of his shoulder. For example, inflating backrest 424*a* while deflating backrest 424*b* while rotating platform 416*a* in the direction indicated by arrow 438*a* may cause contra lateral rotation of the shoulders and pelvis of a user. Alternatively or additional movements may occur sequentially.

In some embodiments, the controller may be programmed for stimulating a pattern of continuous motions in the user. Optionally, pump 436 and/or a motor may be powered for example by batteries, compressed air, AC electrical power (for example via a wall plug). In some embodiments, mechanical elements (for example as illustrated in FIGS. 2A-3B) may be combined with pneumatic elements (for example as illustrated in FIG. 4A). Alternatively or additionally seat platform 416*a* may be tilted using pneumatic backrests in place or and/or along with pneumatic pistons 432*a-c*.

Figure 4B:
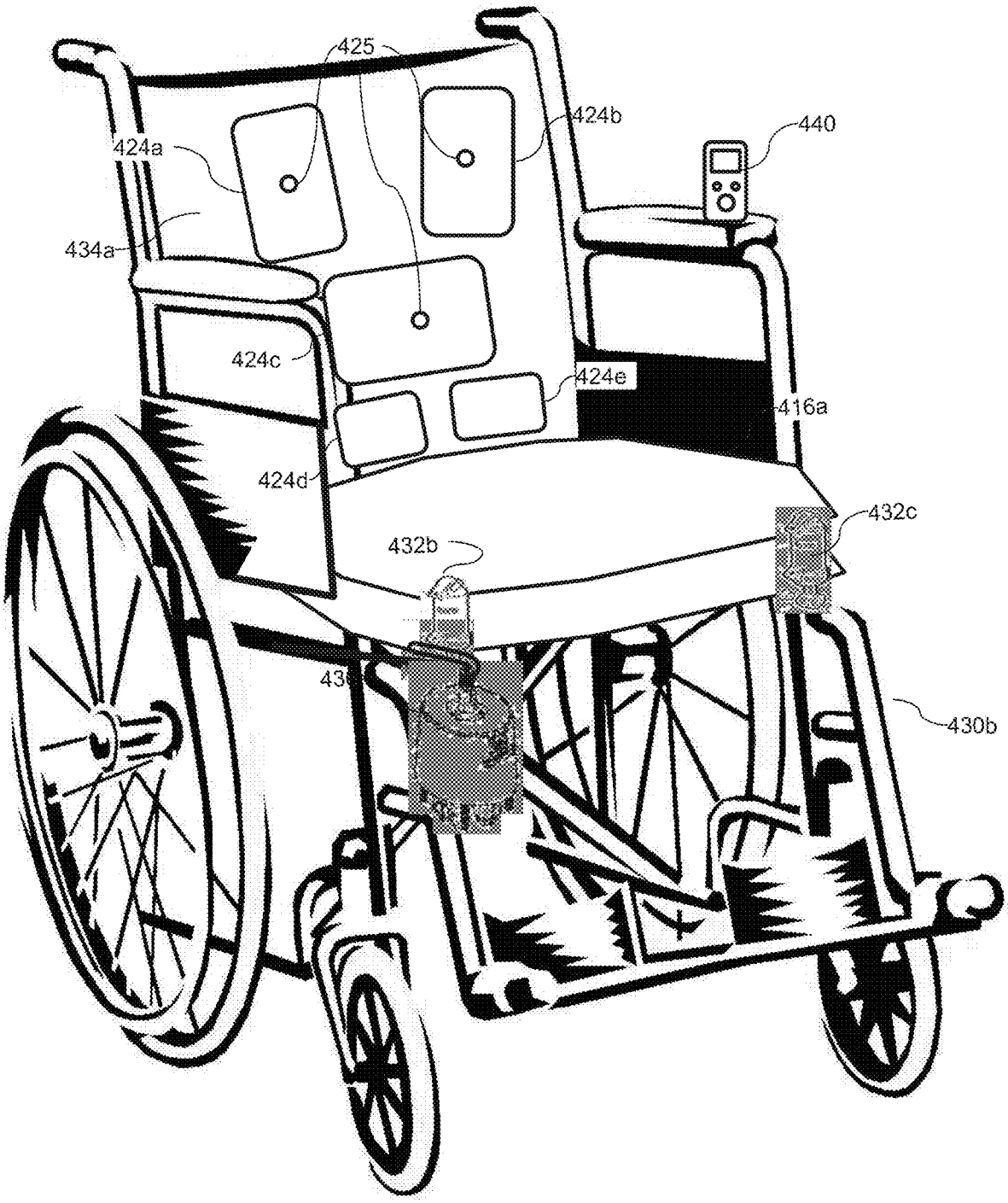
FIG. 4B is a schematic perspective view an exemplary embodiment of an add-on single platform apparatus for stimulating synchronized body motions of a user installed into a wheelchair in accordance with an embodiment of the current invention.

FIG. 4B illustrates the embodiment of FIG. 4A installed in a wheelchair 430*b*. Note that the embodiment of FIG. 4B may optionally use the pneumatic pump of an air cushion and/or air mattress. For example, a person with limited movement who uses an air cushion to avoid pressure sores may connect his existing pump in addition to and/or in place of pump 436. Additionally and/or alternatively, the embodiment of FIG. 4A may be installed into an airplane seat, a bus seat, a car seat, a driver's seat of a truck and/or a bus, a hospital bed, an easy chair and/or other furniture. Alternatively or additionally some or all of the hydraulic components of the exemplary embodiments may include a liquid hydraulic fluid, for example water and/or oil. Backrests 424*a-e* may be attached to the chair using a hook and loop system and/or Velcro™, a strap, a clamp and/or a hanger hook (for example hung over a seat back).

In some embodiments a hydraulic pump and/or a hydraulic actuator and/or a valve may be controlled by a processor. Optionally the processor may be preprogrammed to produce a fixed movement regime. Alternatively or additionally, the processor may be controlled by the user. For example, there may be provided a control panel and/or an interface to control the processor. For example the interface may facilitate communication between the processer and a user device.

An Exemplary Mechanical Platform with Contra-Lateral Seat and Back Rotation

Figure 4C:
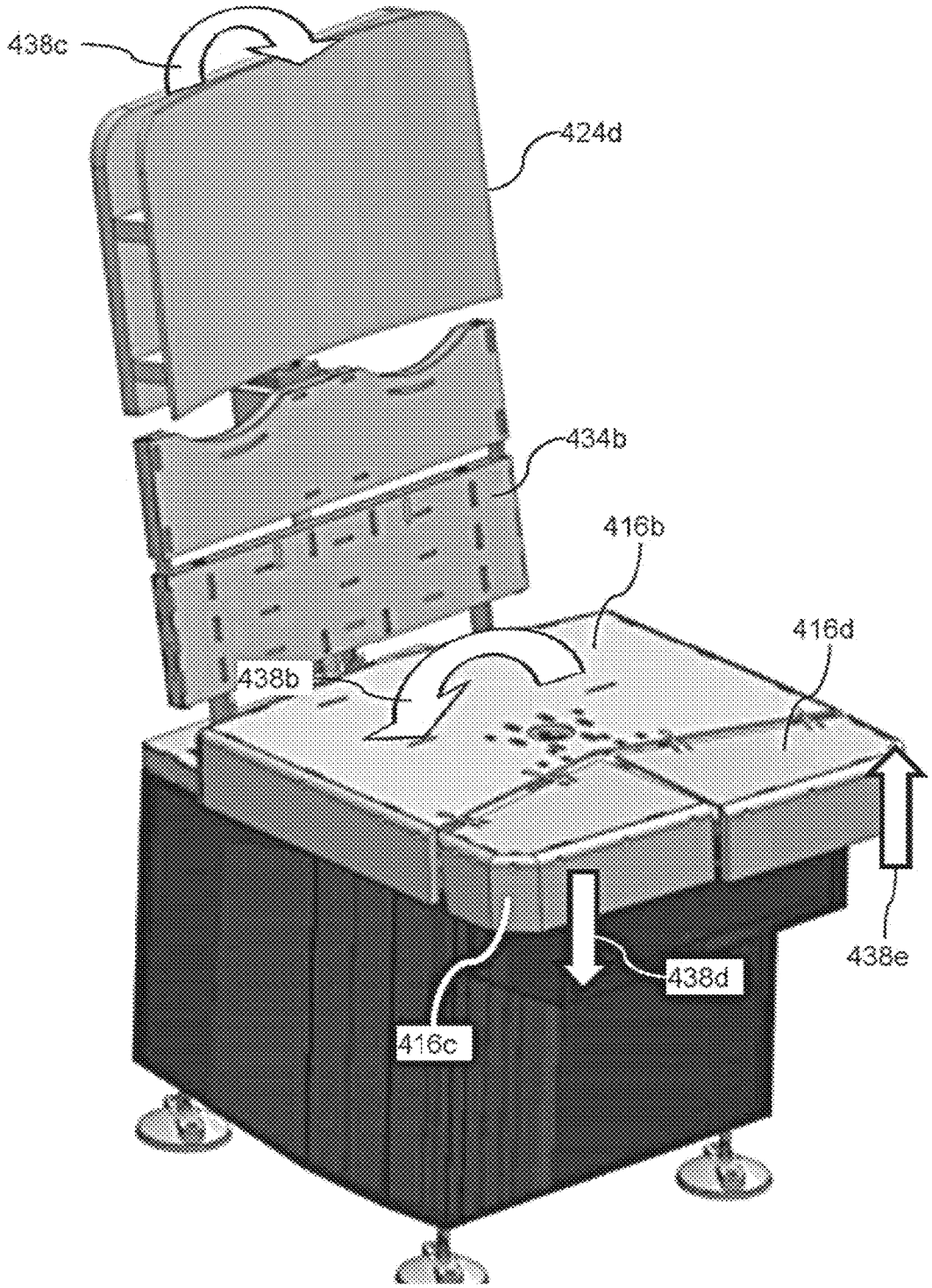
FIG. 4C and FIG. 4D are a perspective views of a treatment chair for stimulating synchronized body motions of a user installed into a wheelchair in accordance with an embodiment of the current invention.

FIG. 4C illustrates an apparatus with rotatable backrest 424*d* and pelvis platform 416*b* and vertically moving thigh platforms 416*c,d* in accordance with an embodiment of the current invention. Optionally, is used to stimulate coordinated walking type movements between the shoulders, pelvis and/or thighs. For example, the apparatus may be mechanically driven to produce contra-lateral movement between the pelvis and shoulders. For example the backrest 424*d* may rotate left when pelvis platform 416*b* rotates right. For example, the apparatus may be mechanically driven to produce contra-lateral movement between the thighs and/or shoulders. For example when the right thigh is raised the left thigh may be lowered. For example the raising of the thighs may be synchronized with rotations of the shoulders and/or the pelvis. For example, the right thigh may be raised when the right shoulder is rotated forward and/or when the pelvis is rotated rightward (the right side of the pelvis is moved backwards). For example, the left thigh may be raised when the left shoulder is rotated forward and/or when the pelvis is rotated leftward (the left side of the pelvis is moved backwards). Alternatively or additionally, the synchronization of the thigh movements with the pelvic and/or shoulders movements may be reversed and/or may be adjusted differently (for example there may be more complicated cycle where thigh movement and pelvis movements are staggered in time, for example first the pelvis and shoulders are turned one way and then the thighs are moved and then the pelvis is rotated back etc). Optionally, a stationary seat back 434*b* may support the lower back of the user. Alternatively or additionally the entire backrest (backrest 424*d* and seat back 434*b*) may rotate. Throughout the cycle, pelvis platform 416*b* is optionally kept level, parallel to the floor and/or horizontal. Keeping pelvic platform 416*b* level may help some users feel stable and confident during the movement.

In some embodiments, the apparatus may include optional handgrips and/or footrests (not shown). The handgrips and/or footrests may be modularly assembled and/or disassembled from the main unit. In some embodiments, pedals may be supplied. Optionally the user actively moves the footrests (for example pedals) for exercise and/or to power the apparatus. Alternatively or additionally, footrests may be moved by the apparatus (for example by a motor). Foot rests may be stationary and/or move for example in circular orbits (for example like pedals) and/or in a rocking motion and/or in an up and down motion. Optionally, movement of the footrests is synchronized with pelvis platform 416*b* and backrest 424*d* and/or thigh platforms 416*c,d*. Optionally the apparatus includes adjustable components to suit different sized users. For example, the height of platform 416*b* may be adjustable. The distance between thigh platforms 416*c,d* and seat back 434*b* and/or back-rest 424*d* may be adjustable. For example, the height of backrest 424*d* may be adjustable.

In some embodiments, the apparatus may be embodied in a custom rehabilitation chair. Alternatively or additionally, the apparatus may be implemented into a rehabilitation bed and/or into a chair for workplaces and/or into a gym type device and/or into a vehicle seat (for example for a car and/or airplane and/or train) and/or into a wheelchair.

In some embodiments, thigh platforms 416*c,d* are optionally made from an elastic material (such as liquid silicon). Optionally a divider separates left platform 416*d* from right platform 416*c*, For example, when pressure is applied to one side, material will flow to the other side and elevate the thigh that rests upon it. For example, when pelvis platform 416*b* is rotated right, there may be less support for the left thigh which will push the left thigh platform 416*d* downward. The downward movement of the left thigh may put pressure on the left thigh platform 416*d* driving fluid to right thigh platform 416*c*, raising the right thigh. Alternatively or additionally, the lift and decent of the thigh platforms 416*c,d* may be done using a motor-driven mechanical mechanism. Alternatively or additionally, while the right thigh descends the left hips may remain motionless and while the left thigh descends the right thigh is motionless.

In some embodiments, the rotation of the platform 416*b* is between to 0-4° to the right and/or 0-4° to the left. Thigh platforms 416*c,d* may rise and descend between 0 to 8 cm. Optionally, the rotating backrest 424*d* may be replaced by separate left and right backrests which may move contralaterally and/or together. Backrests may include a forward-backward motion and/or an inward-outward motion.

In some embodiments back rotation, pelvis rotation, and/or thigh lift/decent may be synched and/or driven by to a single sequence. Optionally the motions are driven by a single driver (for example a motor and/or an actuator and/or a pump). The apparatus may provide speed control for the driver. Alternatively or additionally, various moving parts of the apparatus may be driven by separate drivers for some and/or for each of the motion effects. Optionally the various drivers may be controlled and/or synchronized by a processor. In some embodiments, for example as illustrated in FIG. 4C, when platform 416*b* is turned left (e.g. in the direction of arrow 438*b*), then left thigh platform 416*d* goes up (e.g. in the direction of arrow 438*e*) and right thigh platform 416*c* goes down (e.g. in the direction of arrow 438*d*). Optionally, at the same time right backrest 424*d* rotates rightward (e.g. in the direction of arrow 438*c*). Optionally, at the same time, a right handgrip (not shown) moves backward and/or downward and/or a left handgrip moves forward and/or upward. Optionally, at the same time a right foot platform and/or pedal (not shown) moves in half a circle forward and/or downward and/or a left foot platform and/or pedal (not shown) moves in half a circle backward and/or upward. Optionally then the same motion is initiated to the other side in mirrored and/or a cyclic manner. After the above movements chair 4C may, for example, be moved from the configuration of FIG. 4C to the configuration of FIG. 4D.

Figure 4D:
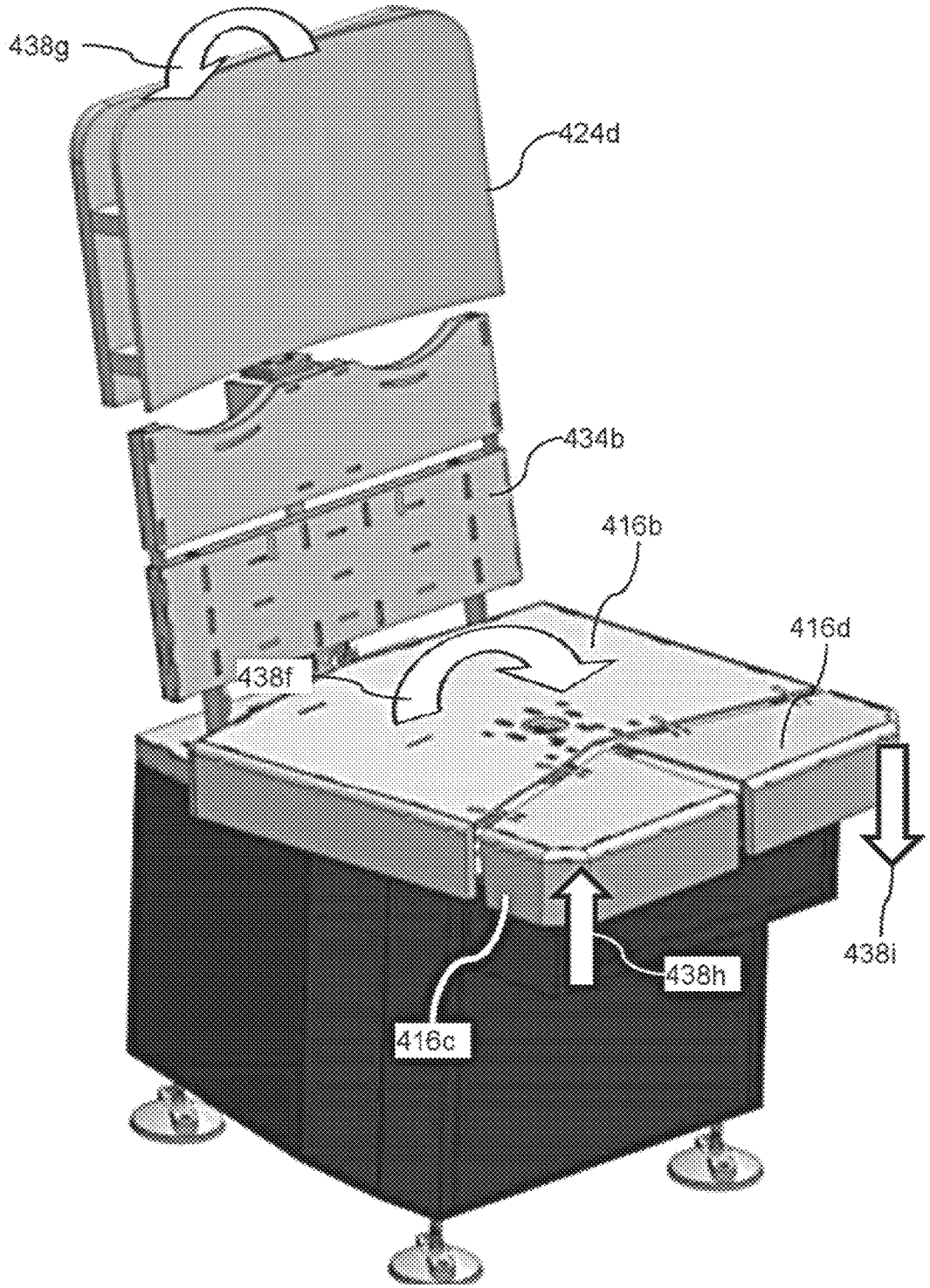

In some embodiments after the movements listed above, the chair returns cyclically from the configuration of FIG. 4D to the configuration of FIG. 4C. For example, platform 416*b* is turned right, (e.g. in the direction of arrow 438*f*), then left thigh platform 416*d* goes down (e.g. in the direction of arrow 438*i*) and right thigh platform 416*c* goes up (e.g. in the direction of arrow 438*h*). Optionally, at the same time right backrest 424*d* rotates left (e.g. in the direction of arrow 438*g*). Optionally, at the same time, a right handgrip (not shown) moves forward and/or upward and/or a left handgrip moves backward and/or downward. Optionally, at the same time a right foot platform and/or pedal (not shown) moves in half a circle backward and/or upward and/or a left foot platform and/or pedal (not shown) moves in half a circle forward and/or downward. Optionally after the above movements, the chair may, for example, be moved from the configuration of FIG. 4D to the configuration of FIG. 4C. Alternatively or additionally, the synchronization of the feet and/or hands with the pelvis and/or shoulders may be reversed and/or rearranged in another manner and/or the cycle may more complex (for example the cycle described above may be considered a two step cycle. There may be a four step cycle wherein some of the movements described above as occurring simultaneously are performed sequentially).

Figure 4E:
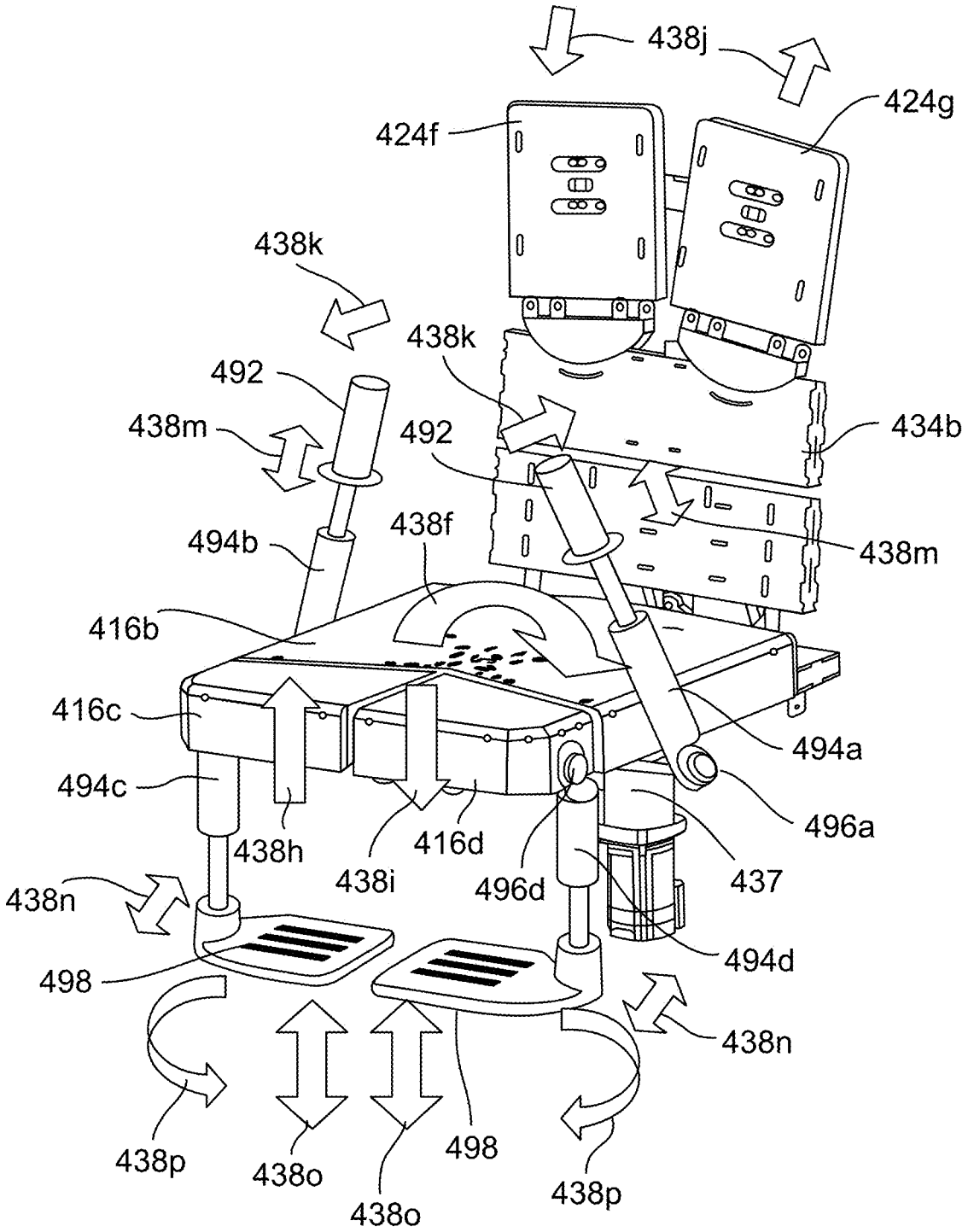
FIG. 4E is a perspective view of a treatment chair with handgrips and footrests in accordance with an embodiment of the current invention.

FIG. 4E illustrates an exercise apparatus including handgrips 492 and footrests 498 in accordance with an embodiment of the current invention. Handgrips 492 optionally move upwards and/or downward and/or forward and/or backward. Footrests 498 optionally move upwards and/or downward and/or forward and/or backward. Optionally the chair includes movable shoulder supports 424*f,g*. Shoulder supports 424*f,g* optionally move forward and/or backward, for example as illustrated by arrows 438*j*. In some embodiments the embodiment of FIG. 4E may be powered by the movements of the user. For example, movements of the arms and/or legs may cause movements of the hips and/or backrests. Alternatively or additionally, some movements may be driven and/or assisted by a motor and/or actuator.

In some embodiments handgrips 492 may be connected to a base 437 of the exercise chair. For example, handgrips 492 may not be connected to pelvic platform 416*b*. For example handgrips 492 may move independently and/or contra laterally with respect to platform 416*b*. For example, handgrips 492 are connected to a base 437 via telescoping poles 494*a,b* and/or a rotating joint 496*a*. For example, handgrips 492 may move forward and/or backward by rotating around joint 496*a*. For example, handgrips 492 may move forward and/or backward (for example as illustrated by arrows 438*k*) and/or upward and/or downward (for example as illustrated by arrows 438*m*) by lengthening and/or shortening telescoping poles 494*a,b*. Optionally, telescoping poles 494*a,b* and/or rotating joint 496*a* are moved by an actuator. Alternatively or additionally, telescoping poles 494*a,b* and/or rotating joint 496*a* may be moved by force applied by the user. For example, telescoping poles 494*a,b* and/or rotating joint 496*a* may have a substantially fixed resistance to movement. Alternatively or additionally, telescoping poles 494*a,b* and/or rotating joint 496*a* may have a variable resistance to movement. For example the resistance may be set according to the exercise level desired from the user.

In some embodiments, the form and/or movement of handgrips 492 may be similarly to Nordic walking sticks. For example, the lengths and/or other dimensions of handgrips 492 may be adjustable to fit patients of varying body dimensions. Motion and/or resistance of handgrips 492 may be synched with the sequence of motions of the other moving parts. For example: when seat platform 416*b* is rotated right and/or when left thigh platform 416*d* goes down, the left handgrip 492 may move backward and/or downward and/or the right handgrip 492 may move forward and/or upward. Alternatively or additionally handgrips 492 may be non-mechanized. For example the user may be allowed operate the handgrips 492 freely and/or completely actively. Hand grips 492 may optionally be foldable and/or detachable. Optionally, the system is operated without the handgrips 492 at some times and/or for some patients and with handgrips 492 at other times and/or for other patients. Alternatively a system might not include handgrips 492.

In some embodiments footrests 498 may be connected to thigh platforms 416*c,d* of the exercise chair. For example, footrests 498 may move along with thigh platforms 416*c,d*. For example footrests 498 may move independently of thigh platforms 416*c,d*. For example, footrests 498 are connected to thigh platforms 416*c,d* via telescoping poles 494*c,d* and/or a rotating joint 496*d*. For example, footrests 498 may move forward and/or backward (for example as illustrated by arrows 438*n*) by rotating around joint 496*d*. For example, footrests 498 may rotate around poles 494*c,d* (for example as illustrated by arrows 438*p*). For example, footrests 498 may move forward and/or backward and/or upward and/or downward (for example as illustrated by arrows 438*o*) by lengthening and/or shortening telescoping poles 494*c,d*. Optionally, telescoping poles 494*c,d* and/or rotating joint 496*d* are moved by an actuator. Alternatively or additionally, telescoping poles 494*c,d* and/or rotating joint 496*d* may be moved by force applied by the user. For example, telescoping poles 494*c,d* and/or rotating joint 496*d* may have a substantially fixed resistance to movement. Alternatively or additionally, telescoping poles 494*c,d* and/or rotating joint 496*d* may have a variable resistance to movement. For example the resistance may be set according to the exercise level desired from the user.

Examples of Possible Movement Regimes

Figure 5:
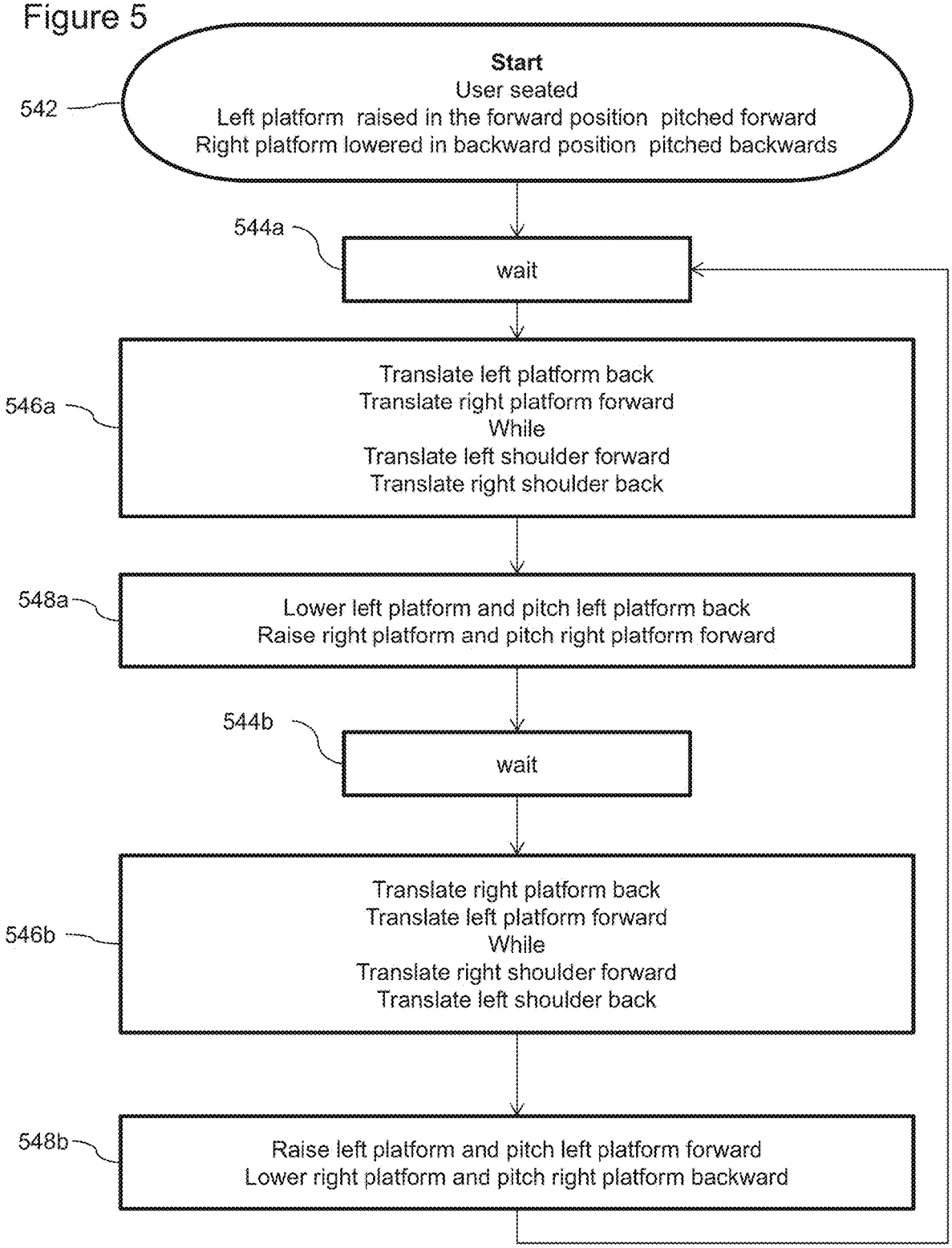
FIG. 5 is a flow chart illustration of an exemplary simulated walking regime stimulating synchronized body motions of a user in accordance with an embodiment of the current invention.

FIG. 5 illustrates an exemplary simulated walking regime that may be performed for example using an embodiment similar to FIG. 2C. In the exemplary regime, each side of the pelvis makes a circuit in the sagittal plane. Optionally opposite sides of the pelvis move in opposite phases. Optionally, the shoulders are moved contra laterally and in opposite phase to the pelvis.

The exemplary regime starts 542 with the left platform raised in a forward position and pitched forward. The exemplary regime starts 542 with the right platform lowered in a backward position and pitched backwards. Optionally system may wait 544*a* in this position, for example for a time ranging between 1 second and 5 minutes.

A first translation 546*a* may optionally include translating the left platform backwards while translating the right platform forward. The shoulders may optionally be moved contra laterally and in opposite phase with respect to the hips.

In some embodiments, following the first translation, the vertical positions of the platforms may be switched 548*a*. For example, the left platform may be lowered and pitched backwards while the right platform is raised and pitched forward. Optionally system may wait 544*b* in this position, for example for a time ranging between 1 second and 5 minutes.

A second translation 546*b* may optionally include translating the left platform forward while translating the right platform backward. The shoulders may optionally be moved contra laterally and in opposite phase with respect to the hips. For example, the left hip is translated forward and the right hip backward, simultaneously and/or sequentially the left shoulder may be translated backward while the right shoulder is translated forward.

In some embodiments, following the second translation, the vertical positions of the platforms may be switched 548*b*. For example, the right platform may be lowered and pitched backwards while the left platform is raised and pitched forward. Optionally the system may restart the process by waiting 544*a* in this position, for example for a time ranging between 1 second and 5 minutes.

Figure 6:
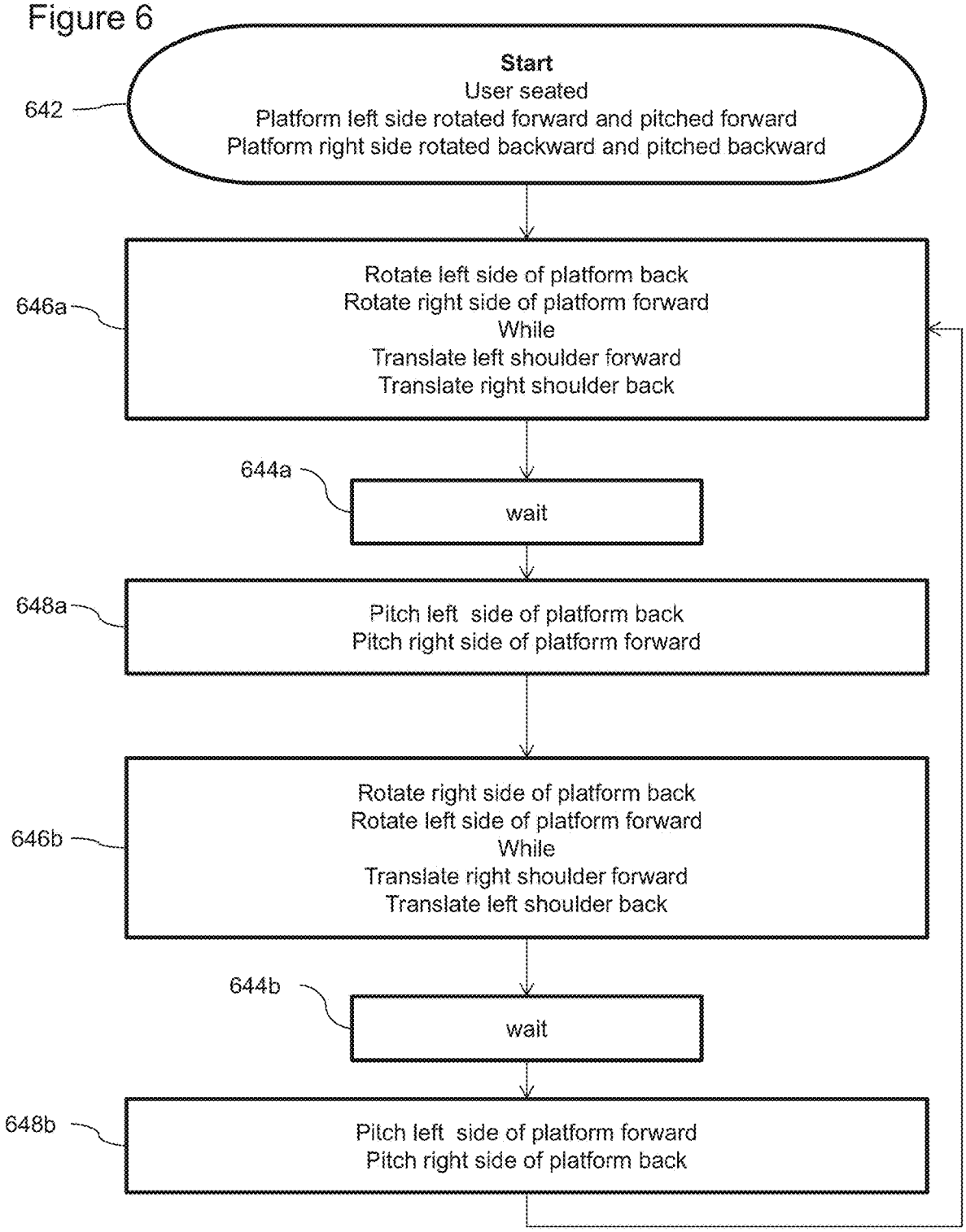
FIG. 6 is a flow chart illustration another exemplary simulated walking regime stimulating synchronized body motions of a user.

FIG. 6 illustrates an exemplary simulated walking regime that may be performed for example using an embodiment similar to FIG. 4A. In the exemplary regime, each side of the pelvis makes a curved circuit while being pitched opposite the movement direction. Optionally opposite sides of the pelvis move in opposite phases. Optionally, the shoulders are moved contra laterally.

The exemplary regime starts 642 with the left side of the platform rotated forward and pitched forward and the right side of the platform rotated backward and pitched backward. Alternatively or additionally the platform may start rolled (tilted) to the side, for example, with the left side upward and the right side downward.

A first rotation 646*a* may include for example rotating the left side of platform backwards while rotating the right side of platform forward. Optionally, at the same time the left shoulder may be translated forward (for example by inflating backrest 424*b*). Optionally at the same time, the right shoulder may be translated backward (for example by deflating backrest 424*a*). Optionally system may wait 644*a* in this position, for example for a time ranging between 1 second and 5 minutes.

After waiting 644*a* the pitch of the seat may optionally be reversed 648*a* for example by pitching the left side of the platform backward and pitching the right side of the platform forward. Alternatively or additionally, the platform may be rolled (tilted) for example with the right side upward and the left side downward.

Following reversion 648*a* there may be an optional second rotation 646*b* including, for example, rotating the left side of platform forward while rotating the right side of platform backward. Optionally, at the same time the left shoulder may be translated backward (for example by deflating backrest 424*b*). Optionally at the same time, the right shoulder may be translated forward (for example by inflating backrest 424*a*). Optionally system may wait 644*b* in this position, for example for a time ranging between 1 second and 5 minutes.

After waiting 644*b* the pitch of the seat may optionally be reversed 648*b* for example by pitching the left side of the platform forward and pitching the right side of the platform backward. Alternatively or additionally the platform may be rolled (tilted), for example, with the right side downward and the left side upward.

The regime may then optionally restart with first rotation 646*a*.

In some embodiments, the shoulders may be abducted and/or adducted, for example during the waiting phase. Alternative or additional movement regimes may include reversing the pitch describe in the examples above and/or changing the pitch during translation and/or rotation. In some embodiments, the shoulders may be moved without the pelvis and/or the pelvis without the shoulders. Additionally or alternatively in some embodiments, the two sides of the pelvis and/or shoulders may be moved in the same phase. Alternatively or additionally, the shoulders and pelvis may be rotated together in the same phase (for example moving the right hip and right shoulder backwards while moving the left hip and shoulder forward and vice versa). Optionally, the user may perform manual movements synchronized to movements of a motion apparatus. For example, the user may twist his neck in the same direction as rotation of the pelvis and/or shoulders and/or the user may twist his neck in the opposite direction of rotation of his pelvis and/or shoulder and/or the user may tilt his head up and/or down and/or the user may cross his arms and/or the user may extend his arms and/or legs forward and/or the user may extend his arms sideways.

In some of the exemplary embodiments described above actions described as occurring simultaneously may optionally occur sequentially. In some of the exemplary embodiments described above actions described as occurring sequentially may optionally occur simultaneously.

Embodiments of a Chair Stimulating Thigh Rotation

One movement that may characterize human walking is an inward twist as the leg completes a forward stride. In some embodiments, a system according to the current invention, may simulate this kind of movement.

Figure 7A:
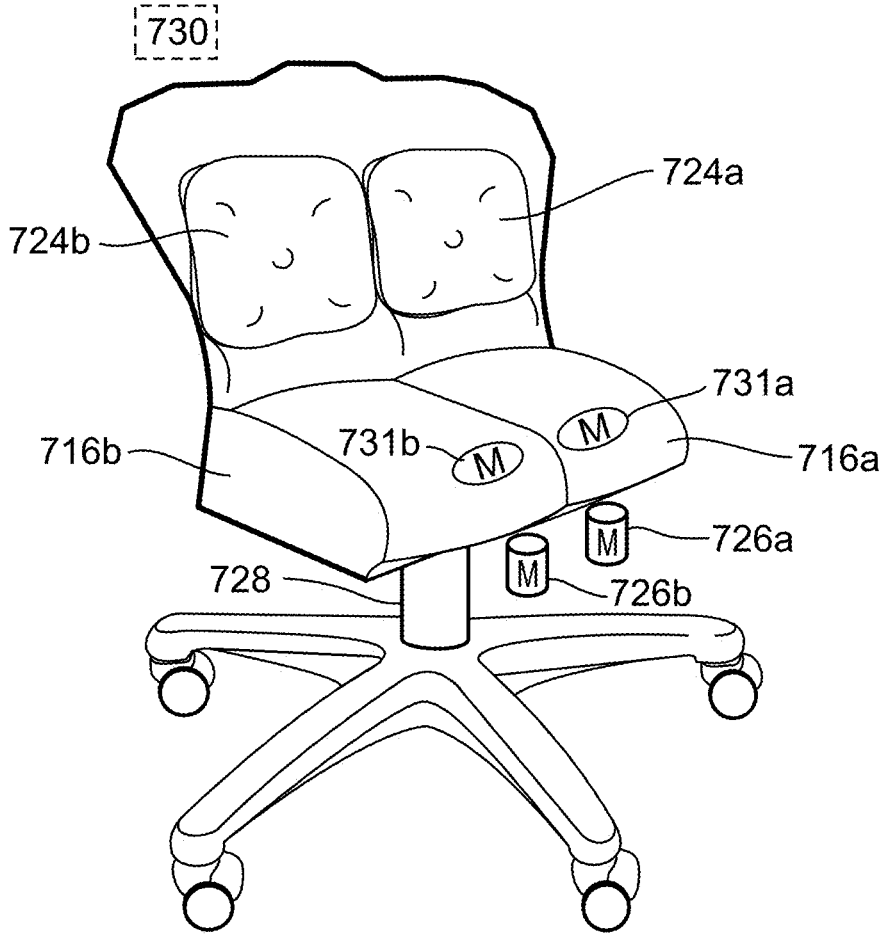
FIG. 7A is a schematic perspective view of an exemplary embodiment of an apparatus for stimulating movement, including inner twisting of a user's thigh in accordance with an embodiment of the current invention.

For example in FIG. 7A, a chair 730 is provided with separated left and right leg platforms 716*a* and 716*b*. Optionally the platforms 716*a,b* include cushions and corresponding magnetic actuators 726*a,b*. In the exemplary embodiment, when each actuator 726*a,b* is activated, it pulls down upon a respective magnetized cushion insert 731*a,b* to compress an inner thigh portion of the corresponding platform 716*a,b*. In some cases, compressing an inner thigh portion of a platform 716*a,b* may impart an inward twist downward motion to the corresponding thigh of a user sitting in chair 730.

In some embodiments, chair 730 may be supported by a swivel mount 728. Optionally swivel mount 728 may include an actuator to rotate the seat of chair 730. For example, in the embodiment of FIG. 7A, the seat of chair 730 may rotate independently from the back. Optionally, chair 730 may include back support cushions 724*a,b*. Optionally, cushions 724*a,b* may move, for example by any of the means described above. Optionally, rotating the seat, lowering the inward thigh and/or moving back cushions 724*a,b* may be activated independently and/or in a synchronized fashion.

In some embodiments, cushions and/or an actuator similar, for example, to those illustrated in FIG. 7A may be provided as an add-on attachment to an existing chair or other piece of furniture. For example they may be added to a wheelchair or an office chair or the like.

Figure 7B:
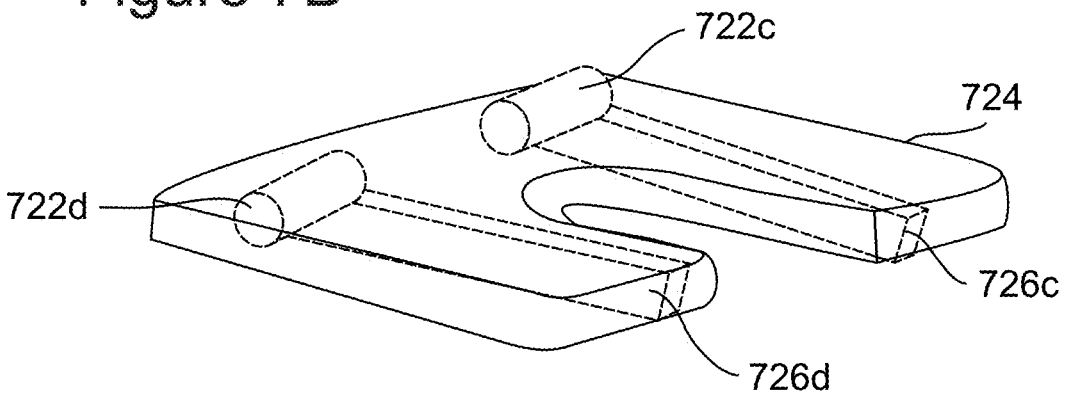
FIG. 7B is a schematic perspective view of an exemplary embodiment of an add-on horseshoe seat apparatus for stimulating movement, including inner twisting of a user's thigh in accordance with an embodiment of the current invention.

FIG. 7B illustrates an alternative exemplary embodiment of a seat that may impart a twisting motion to a user's thighs. For example in the embodiment of FIG. 7B, actuators 722*c,d* impart a torque to lever arms 726*c,d* to raise or lower the inner thigh portion of a horseshoe shaped seat cushion 724. For example, actuators 722*c,d* may include electric motors or stepper motors. Alternatively or additionally, actuators 722*c,d* may include biasing mechanisms (for example springs). For example springs may bias lever arms 726*c,d* upward and a cable/motor system (for example similar to cable 231 and motor 222*b*) may pull the ends of lever arms 726*c,d* downward in an alternating fashion to cause for example a cyclic motion.

In some embodiments, the seat of FIG. 7B may be build into a wheelchair and/or a commode and/or an office chair. Alternatively or additionally, the embodiment of FIG. 7B may be provided as an attachment for existing chairs, toilets, beds and/or the like.

An Exemplary Embodiment of a Movement Regime

Figure 8:
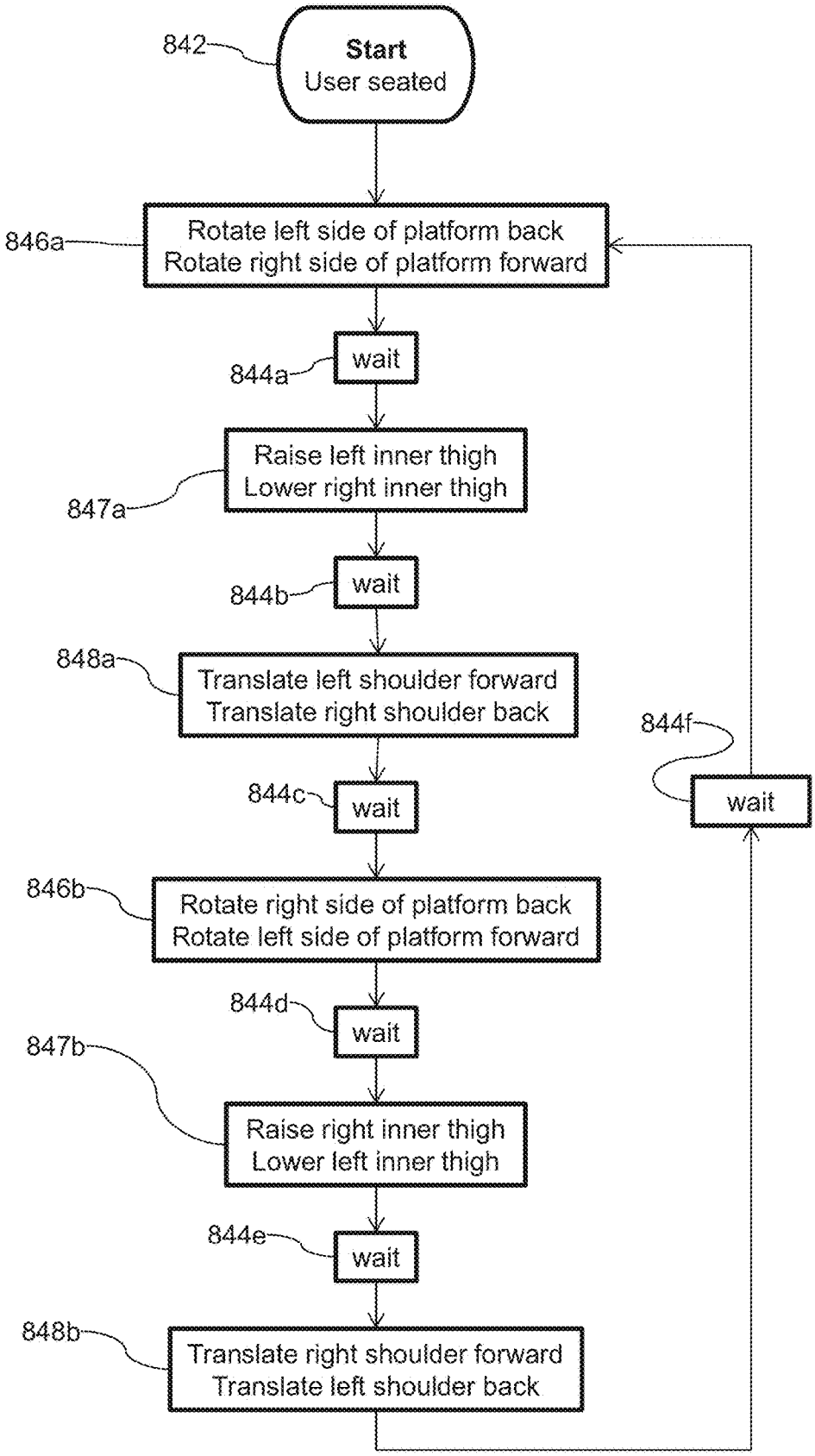
FIG. 8 is a flow chart illustration of a movement regime including an inner twisting of a user's thigh in accordance with an embodiment of the current invention.

FIG. 8 illustrates an exemplary simulated walking regime that may be performed for example using an embodiment similar to FIG. 7A. In the exemplary regime, each side of the pelvis makes a curved circuit while being pitched opposite the movement direction. Optionally opposite sides of the pelvis move in opposite phases. Optionally, the shoulders are moved contra laterally and in opposite phase to the pelvis.

The exemplary regime starts 842 with the left side of the platform rotated forward and the right side of the platform rotated backward.

In some embodiments, a first rotation 846*a* may include for example rotating the left side of platform backwards while rotating the right side of platform forward.

Optionally system may wait 844*a* in this position, for example for a time ranging between 1 second and 5 minutes.

After waiting 844*a* the right thigh of the user may be pitched downward and rotated inward 847*a* for example by lowering the inner side of the platform 716*b*. Optionally at the same time, the left inner thigh may be pitched upward and raised, for example by allowing the inner front side of platform 716*a* to rise to its upward biased position. Optionally, the pelvis of the user may be kept parallel to the floor during the exercises.

Optionally system may wait 844*b* in this position, for example for a time ranging between 1 second and 5 minutes. Then the shoulders of the user may optionally be moved 848*a* contra laterally. For example, the left shoulder maybe translated forward (for example by inflating cushion 724*a*). Optionally at the same time, the right shoulder may be translated backward (for example by deflating cushion 724*b*).

Optionally system may wait 844*c* in this position, for example for a time ranging between 1 second and 5 minutes.

There may follow an optional second rotation 846*b* including, for example, rotating the left side of platform forward while rotating the right side of platform backward.

Optionally system may wait 844*d* in this position, for example for a time ranging between 1 second and 5 minutes.

In some embodiments, after waiting 844*d* the left thigh of the user may be pitched downward and rotated inward 847*b* for example by lowering the inner left side of the platform 716*a*. Optionally at the same time, the right inner thigh may be pitched upward and raised, for example by allowing the inner front side of platform 716*b* to rise to its upward biased position.

Optionally system may wait 844*e* in this position, for example for a time ranging between 1 second and 5 minutes. Then the shoulders of the user may optionally be moved 848*b* contra laterally. For example, the right shoulder may be translated forward (for example, by inflating cushion 724*b*). Optionally at the same time, the left shoulder may be translated backward (for example by deflating cushion 724*a*).

Optionally system may wait 844*f* in this position, for example for a time ranging between 1 second and 30 minutes.

The regime may then optionally restart with first rotation 846*a*.

In some embodiments, the shoulders may be abducted and/or adducted, for example during the waiting phase. In some embodiments, the shoulders may be moved without the pelvis and/or the pelvis without the shoulders. Additionally or alternatively in some embodiments, the two sides of the pelvis and/or shoulders may be moved in the same phase.

In some embodiments described above as actions described as occurring sequentially may occur simultaneously. In some embodiments some or all of the actions described above as occurring after a waiting period, may occur immediately.

Figure 9:
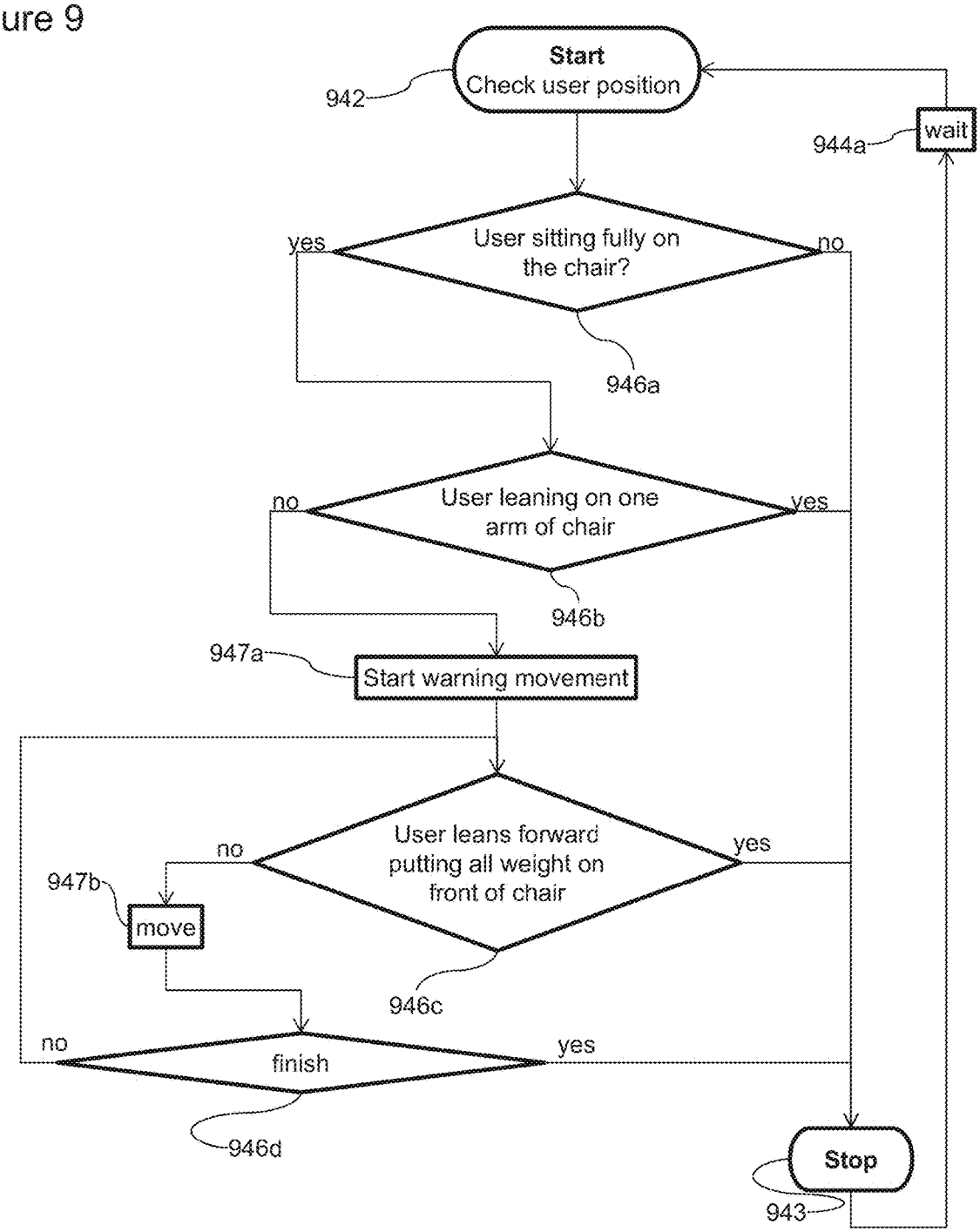
FIG. 9 is a flow chart illustration of use of sensors to adjust a movement regime in accordance with an embodiment of the current invention.

An Exemplary Embodiment of Use of Sensors to Control Activation of a Movement System FIG. 9 is a flow chart illustration of an exemplary method of adjusting a movement regime according to a sensor output. Particularly, in the exemplary embodiment, before starting the movement regime, the system checks the sitting position of the user. Optionally, if the user is sitting in a position that is not proper for starting the device and/or the user is sitting in a position that indicates that he may not want to be disturbed by movement of the device, the device is not started. Optionally when the device is started, it is started with a warning movement and the user is given time to react by for example sitting up on the edge of the chair to indicate that he does not want movement to start. Optionally, during the movement regime the user may shift his sitting position to indicate his preference to stop the regime. Optionally, when the user signals that he wants to stop, the system will stop.

In some embodiments, when a time comes up for a scheduled movement of movement inducing system, before starting and/or restarting 942 moving the system first checks via sensor outputs the position of the user. Optionally, if the user is not in the proper posture 946*a* (sitting all the way on the chair) then the movement regime is not started, and the system stops 943 and/or waits 944*a* and/or checks before attempting to restart 942.

Optionally, if the user is in a position that implies that he might not want to be disturbed because he is involved in another activity (for example, the user is in a conversational posture 946*b*, for example leaning on one armrest talking to someone) then the movement regime is not started, and the system stops 943 and waits 944*a* before attempting to restart 942.

Optionally, before the movement regime 947*b* is started, a warning movement 947*a* is made, if the user indicates 946*c* that he doesn't want the chair to start moving right now, for example by sitting up on the front edge of the chair, then the system stops 943 and waits 944*a* before attempting to restart 942. The warning movement may include, for example a minimal movement or vibration that the user will feel. The user minimal movement may, optionally not disturb him or others. This may prevent, for example, the chair from interrupting an important conversation or a delicate process in which the user is involved.

Optionally, when the chair does start movement regime 947*b*, it periodically and/or constantly checks for indication 946*c* that the user desires the system to stop. Optionally, if there is no such indication the system goes on until it finishes 946*d* movement regime 947*b*. After finishing 946*d* the movement regime 947*b*, the chair may optionally stop 943 and/or wait 944*a* until the next scheduled movement Alternately or additionally, there may be a position by which the user can indicate to the system that he wants the chair to start moving even when there is no scheduled movement.

Awareness Through Movement Regimes

Figure 10:
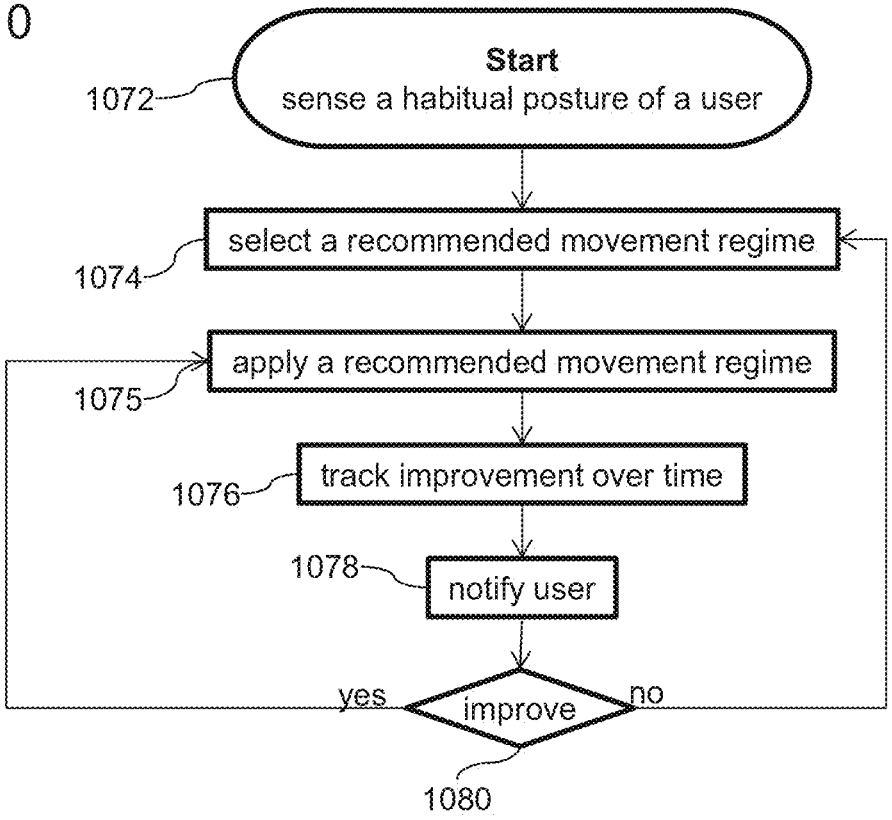
FIG. 10 is a flow chart illustration of use of a apparatus in applying an awareness through movement remedial regime in accordance with an embodiment of the current invention.

FIG. 10 is a flow chart illustration of an exemplary method to train a user to develop healthy behaviors, for example habitual postures and/or movements. For example, sensor output may be processed to detect 1072 a tendency of a user to lean preferentially on the left or right side. For example, over a long time, it may be found that the user leans 20% of the time on the right armrest, 30% of the time on the back of the chair and 50% on the left armrest. Optionally, a recommended movement routine may be selected 1074 and applied 1075. For example, the apparatus may include a library of therapeutic movement regimes for various habits. For example, a stored regime for left leaning may include a lot of sideward swaying movements to strengthen the user's awareness of such movements and shift him out of habitual patterns. Over time sensor output may optionally be monitored to track 1076 improvements. The results may optionally be reported 1078 to the user. If 1080 there is improvement then the treatment regime may optionally be applied 1075 again. If 1080 there is no improvement, then a new regime may optionally be selected 1074.

Figure 11:
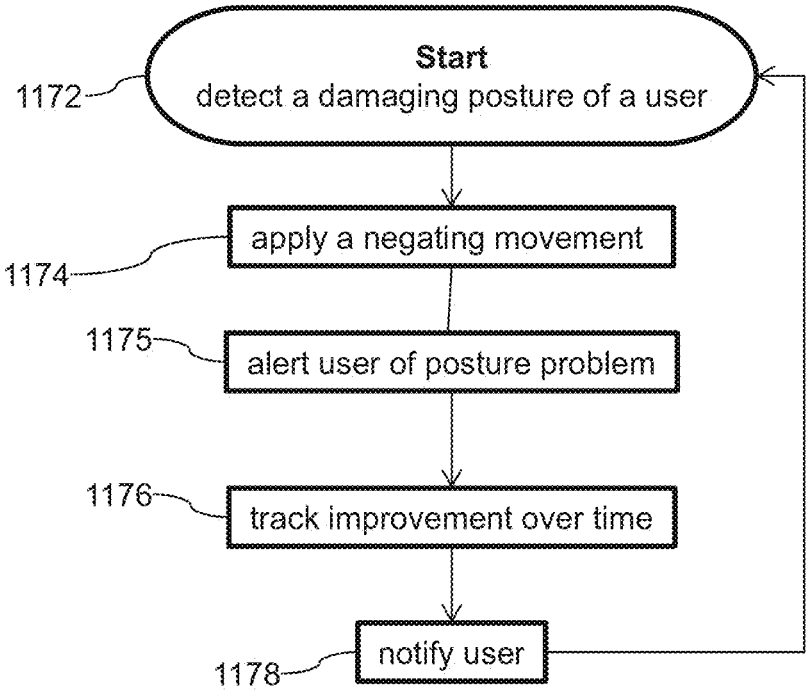
FIG. 11 is a flow chart illustration of use of an apparatus in applying an awareness through movement regime.

FIG. 11 is a flow chart illustration of an exemplary method to alert a user to unhealthy behavior, for example a posture and/or a movement, and/or to reduce such behaviors using a movement apparatus. For example, sensor may detect 1172 that the pressure on a user's thighs is much greater than the force on his buttocks, which may imply, for example, hunching forward or lack of support for the feet. Optionally, when overpressure on the thighs is detected 1172, the movement apparatus may move 1174 the user's thighs in such a way that he will straighten up in his chair. Additionally or alternatively, apparatus may react by alerting the user of his posture, for example to help the user train himself to avoid this posture. For example, for a user who too often puts his weight on his thighs, when high thigh pressure is detected 1172 an actuator may be activated alerting 1175 the user making him aware of how he is. For example, the armrest may be vibrated to remind the user to lean on the armrest. Optionally, postures may be tracked 1176 over time. Statistics may be collected and/or reported 1178 to the user. Examples of postures and/or movements that may be treated may include slouching, leaning too much to one side, sitting too far back on the chair and/or sitting to far forward on the chair. Sensors may, for example, be located in the back of a chair, the seat of a chair and/or the armrests of a chair. Therapeutic regimes and/or alerts may include for example any of the movements listed herein above.

Various embodiments and aspects of the present invention as delineated hereinabove and as claimed in the claims section below find experimental support in the following example.

EXAMPLES

Reference is now made to the following example, which together with the above descriptions illustrates some embodiments of the invention in a non limiting fashion.

A first-in-man study was conducted. The study included 9 meetings (sessions) with a single rehab patient. The purpose of the study was to examine the effects of a device built and employed in accordance with the present invention on the patient's posture and walking ability based on self-reported and objective scales.

Method:

The Patient:

The patient was a 59 year old woman suffering from Multiple Sclerosis (MS). Her walking ability was severely damaged. In her daily life the patient used a rollator and a wheelchair and could not usually walk more than about 1-2 unstable steps without external support.

The Device Used for the Study:

The device used in the study was similar to the device illustrated in FIG. 4C including:

1. three motion mechanisms: (a) a backrest, (b) a sitting platform and (c) left and right thigh platforms;
2. the backrest platform: rotational around a central axis, with a range of motion between +2 to −2°;
3. the sitting platform was kept parallel to the ground and rotated around a central axis with a range of motion between +4 to −4°
4. the thigh platforms moved vertically from between an upper position level with the sitting platform and a lower position 1 cm below the sitting platform;
5. motions of the three motion mechanisms were synched, back rotation and sitting rotation were contra-lateral; the left hip descended when the sitting platform rotated rightward and returned to the upper position when the sitting platform rotated leftward; the right hip descended when the sitting platform rotated leftward and returned to the upper position when the sitting platform rotated rightward;

6. each cycle was completed in approximately 5 sec.

Procedure:

Pretest Phase:

Each meeting begins with the patient sitting down on her wheelchair to rest for a few minutes. Then the patient is requested to stand up and to rate the quality her standing from 1 to 10 (1 very poor, 10 excellent). The patient is then requested to walk and to rate the quality of her walking from 1 to 10 (1 very poor, 10 excellent) and the number of unsupported steps she makes is counted.

First Test Phase:

The patient sits on the device and the device is activated for 5 minutes. Then the patient is requested to rest for a few minutes and then the same measures are taken (the patient rates her standing quality from 1 to 10 and the number of steps she makes without support is counted then the quality of her walking rated from 1 to 10).

Second Test Phase:

The patient sits on the device and the device is activated for an extra 5 minutes. Then the patient is requested to rest for a few minutes and then the same measures are taken (the patient rates her standing quality from 1 to 10 and the number of steps she makes without support is counted then the quality of her walking rated from 1 to 10).

The experiment included nine sessions that were recorded on video.

Hypothesis:

Our expectations were that the patient's self-report rates for unsupported standing will improve and that her standing will appear more stable after sitting on the device for 5 minutes and improvement will increase after sitting on the device for an extra 5 minutes. In addition, we have expected that walking will be easier (self-reported rates and lower frequency of rests) with the support of the rollator.

Results:

The results are summarized in table 1 below. In some cases the patient was not asked for her ratings. In some cases we have included her verbal testimony. Although significant unsupported walking was not in our original expectation, we have included the number of unsupported steps that the patient made in each one of the phases as the first number in bold. In cases when the patient made a number of unsupported steps after using the device and stumbled in the middle, we have stated the number of overall steps and mentioned in brackets the number of brakes she took, i.e., "S" stands for "stumbles"—meaning the patient had to support herself (usually gave a hand to the experimenter) before she continued walking alone. Patent comments in each session are recorded below the number of steps.

TABLE 1

Experimental results:

| Session # and date | | pre test phase | Post test phase (after 5 min) | Post test phase (after an additional 5 min.) |
|---|---|---|---|---|
| 1. 27 Sep. 2013 | # of steps | 1 | 1* | 2 ("I didn't experience such a confident step for a long time. This is fun") |
| | grade walk | | | |
| | grade stand | | | |
| 2. 30 Sep. 2013 | # of steps | 1 | 0 (does not feel confident to walk) | 2 |
| | grade walk | 2-3 | | 7 |
| | grade stand | 2-3 | | 8 |
| 3. 25 Oct. 2013 | # of steps | 0 | 10 (2 S 8) Sits down for a 4 minute rest. 40 (14 S 13 S 13) | 84 (10 S 16 S 10 S 12 S 9 S 5 S 22) |
| | grade walk | | "I can't remember walking like this for a long time. I attribute positive changes in my everyday life to the device") | "For the first time in 2 days I can lift my left leg. I can't remember the last time I could walk like this" |
| | grade stand | | "I feel unstable" | "I feel upright and stable. I'm very excited" |
| 4. 30 Oct. 2013 | # of steps | 12 with support of one hand | 51 (12 S 8 S 3 S 6 S 14 S 8) | 53 (8 S 9 S 14 S 22) |
| | grade walk | 5-6 | | 7 |
| | grade stand | | | "I felt improvement from the pretest phase" |

TABLE 1-continued

| Experimental results: | | | | |
|---|---|---|---|---|
| Session # and date | | pre test phase | Post test phase (after 5 min) | Post test phase (after an additional 5 min.) |
| 4. 30 Oct. 2013 | # of steps | 12 with support of one hand | 51 (12 S 8 S 3 S 6 S 14 S 8) | 53 (8 S 9 S 14 S 22) |
| | grade walk | 5-6 | | 7 |
| | grade stand | | | "I felt improvement from the pretest phase" |
| 5. 1 Nov. 2013 | Before the test begins patient reports: "At home I walked 1.5-2 m without support for the first time in months. When stepping out of the shower I could do everything alone without any support. This is very unusual" | | | |
| | # of steps | 10 | 79 (9 S 10 + turning left + 12 S 10 S 8 S 10 S 20) | 87 (9 S 26 S 21 + U turn on the left leg + 9 S 22) ("I felt I am more daring, I can't remember the last time I turned without support") |
| | grade walk | 7 | 9 | |
| | grade stand | 7 | 9 | 10 |
| 6. 8 Nov. 2013 | Before the test begins patient reports: "the previous week was uneasy. My legs bent" | | | |
| | # of steps | 0 Patient can't walk without major support | 34 (12 S 11 S 8 S 3) | 39 (25, stops and turns without stumble, 14) |
| | grade walk | 1.5 | 5 "I walked without any support and this makes the difference" | "I feel that I can lift my left leg and not just drag it . . . I felt I can stabilize myself" |
| | grade stand | 2 "I don't feel stable" | 4 | 5 |
| 7. 14 Nov. 2013 | Before the test begins patient reports: "the previous week was uneasy. My legs bent" | | | |
| | # of steps | 33 (20 S 13) | 52 (20 S 9 S 12 S 11) | 108 (31, stand without support + U turn on left foot without support + 47, S, 6 + U turn on left foot + 24) |
| | grade walk | 5 | 7 | 10 |
| | grade stand | 5 | 6 | 9 |
| 8. 21 Nov. 2013 | # of steps | 16 (+turn to sit on the device) | 105 | 120 |
| | grade walk | 5.5 | 8.5 | |
| | grade stand | 6 | 7 | 9.5 |
| 9. 29 Nov. 2013 | Patient reports she uses the rollator less than before. Therefore she suffers less pain in her arm. | | | |
| | # of steps | 52 (21 turns right, 15 turns right, 16) | 114 (35 turns left, 27 turns right, 26 turns left, 26 turns right to sit on the device) | 161 (32 turns left, 28 turns right, 101 turns to sit on device) |
| | grade walk | 8 | 9.5 | 10 |
| | grade stand | 7 | 8 | 9 |

Summary of Results:

We generally observed improvement (increased ability to walk, improved subjective feeling) after each use of the device. Improvement generally increased after using the device the second time (post test 2). In addition, we witnessed an improvement from session to session. Except for a regression in the 6th meeting, there was a consistent improvement in the patient's ability to walk and in the quality of her standing. The patient reported a major and unexpected improvement is in her everyday life. Patient reported more independence at home and ability to walk at home without support. The patient reported less leaning on the rollator in daily walking, and less tension (pain) in the shoulders. In addition, she reported an ability to walk more with less effort.

CONCLUSIONS

The results of the tests were not anticipated before we began, neither by us, nor by the patient. We were surprised to discover the impact of the device on the patient's immediate walking and standing ability and even more astonished to learn about the device's impact on the patient's everyday life. The fact that the patient reported that she ceased to need to lean on the rollator when walking at home implies that her walking pattern is improved and thus requires less effort.

Figure 12:
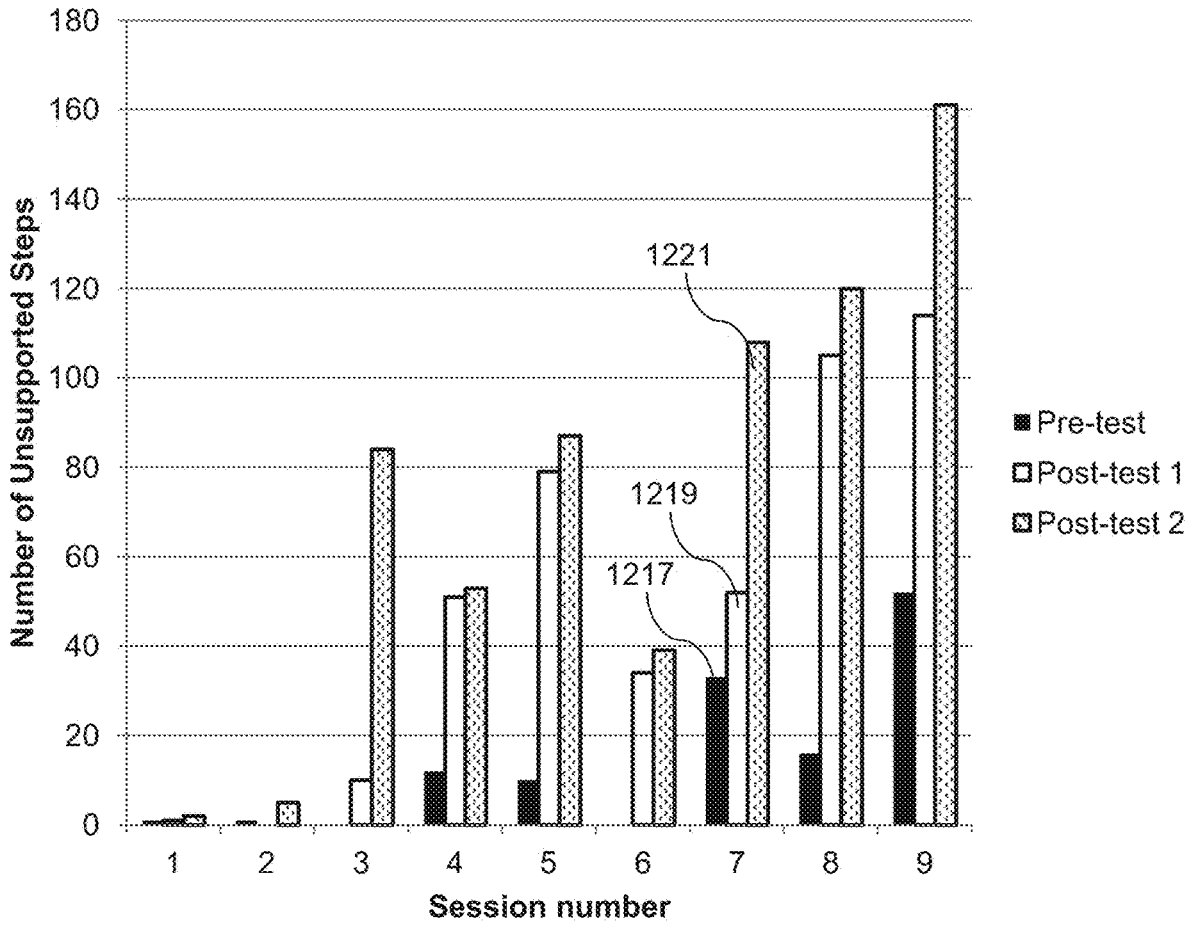
FIG. 12 is a bar graph summarizing experimental results from testing a therapeutic chair in accordance with an embodiment of the current invention.

The experimental results are summarized in FIG. 12. The bars represent the number of steps taken in each test. Black bars represent the results of the preliminary test 1217 of each session (before using the apparatus), dotted bars represent the results of the first post test 1219 (after using the apparatus once for 5 minutes) and the dotted bars represent the results of the second post test 1221 (after using the apparatus twice for 5 minutes) of each session.

General Notes

It is expected that during the life of a patent maturing from this application many relevant technologies will be developed and the scope of the various terms in the application are intended to include all such new technologies a priori.

As used herein the term "about" refers to ±5%

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An apparatus for imparting motion to a user comprising:

one or more seat platforms;

one or more movable shoulder supports;

wherein at least one of said one or more seat platforms and said one or more movable shoulder supports is configured to rotate around a vertical axis;

a stationary lower back support; and a controller configured to control one or more actuators, each of said actuators coupled to at least one of: said one or more seat platforms and said one or more movable shoulder supports for repeatedly moving at least one of said one or more seat platforms and one or more movable shoulder supports around said vertical axis simultaneously to effect at least one of:

synchronized contra lateral shoulder and pelvic motion of the user; and synchronized contra lateral shoulder and thigh motion of the user;

wherein said moving of said one or more seat platforms and one or more movable shoulder supports is with respect to said lower back support.

2. The apparatus of claim 1, wherein said movable shoulder supports include a left shoulder support and a right shoulder support, said one or more actuators effecting movement of said left shoulder support in an opposite direction with respect to a movement of said right shoulder support.

3. The apparatus of claim 1, further comprising:

a sensor selected from the group consisting of a pressure sensor, a weight sensor and a movement sensor, and wherein movements of said at least one of said one or more seat platforms and one or more movable shoulder supports are adjusted according to an output of said sensor.

4. The apparatus of claim 3, further comprising:

a processor, said processor configured to activate said one or more actuators according to an output of said sensor.

5. The apparatus of claim 1, wherein a pelvic support of said one or more seat platforms remains horizontal during said moving.

6. The apparatus of claim 1, further comprising: a handgrip.

7. The apparatus of claim 6, wherein at least one of said one or more seat platforms and one or more movable shoulder supports is configured to move independently of said handgrip.

8. The apparatus of claim 1, further comprising:

a thigh platform connected to at least one of said one or more actuators for repeated movement of a right thigh and a left thigh in opposite phases synchronized to at least one of:

said one or more seat platforms; and said one or more movable shoulder supports.

9. The apparatus of claim 8, wherein a right thigh platform moves upward as a right side of said one or more seat platforms moves backwards.

10. The apparatus of claim 8, wherein a right foot platform moves upward as a right side of said one or more seat platforms moves backwards.

11. The apparatus of claim 1, further comprising:

a foot platform connected to said actuators for repeated movement of a right foot and a left foot in opposite phases synchronized to said one or more seat platforms.

12. The apparatus according to claim 1, wherein said one or more seat platforms is movable relative to a spine of the user; and wherein said one or more movable shoulder supports are movable forward and backward relative to the spine of the user.

13. The apparatus according to claim 1, wherein said one or more seat platforms are movable;

said one or more movable shoulder supports are movable relative to a spine of the user; and wherein said one or more actuators are configured to at least one of rotate the user's pelvis, twist the user's back, and bend the user's back in any direction.

14. A method for imparting motion to a user comprising:

supporting said user on one or more seat platforms and one or more movable shoulder supports;

wherein at least one of said one or more seat platforms and said one or more movable shoulder supports is configured to rotate around a vertical axis;

supporting a lower back of the user with a stationary lower back support;

moving said one or more seat platforms repeatedly with an actuator wherein said actuator is in communication with a controller, and effecting contra lateral simultaneous synchronized movement of said one or more movable shoulder supports with respect to said one or more seat platforms, to induce at least one of:

contra lateral shoulder and pelvic motion to the user; and contra lateral shoulder and thigh motion of the user;

while said user is supported on said one or more seat platforms and one or more movable shoulder supports.

15. The method of claim 14, wherein said motion mimics a walking motion.

16. The method of claim 14, further comprising:

sensing a position of the user; and adjusting at least one of said moving and said effecting said moving according to an output of said sensing.

17. The method of claim 14, wherein said motion has a repeating period of between 2 and 10 seconds.

18. The method of claim 14, further including: supplying a handgrip for grasping by said user during said moving.

19. The method of claim 18, wherein said moving is independent of a position of said handgrip.

20. The method of claim 14, further comprising:

moving upward a right thigh while a right side of said pelvis moves backwards.

* * * * *